US011257450B2

(12) United States Patent
Koo et al.

(10) Patent No.: US 11,257,450 B2
(45) Date of Patent: Feb. 22, 2022

(54) DISPLAY APPARATUS AND METHOD OF DRIVING DISPLAY PANEL USING THE SAME

(71) Applicant: Samsung Display Co., LTD., Yongin-si (KR)

(72) Inventors: Jahun Koo, Asan-si (KR); Kyung-Hun Lee, Yongin-si (KR)

(73) Assignee: Samsung Display Co., Ltd.

( * ) Notice: Subject to any disclaimer, the term of this patent is extended or adjusted under 35 U.S.C. 154(b) by 489 days.

(21) Appl. No.: 15/906,058

(22) Filed: Feb. 27, 2018

(65) Prior Publication Data

US 2019/0005907 A1 Jan. 3, 2019

(30) Foreign Application Priority Data

Jul. 3, 2017 (KR) ..... 10-2017-0084501

(51) Int. Cl.
*G09G 3/36* (2006.01)

(52) U.S. Cl.
CPC ..... *G09G 3/3648* (2013.01); *G09G 3/3607* (2013.01); *G09G 3/3677* (2013.01); *G09G 2300/0452* (2013.01); *G09G 2320/0242* (2013.01)

(58) Field of Classification Search
CPC ..... G09G 3/3648; G09G 3/2051; G09G 2320/0673; G09G 2330/021; G09G 2310/0264; G09G 2340/16; G09G 3/3607; G09G 3/3677; G09G 2300/0452; G09G 2320/0242; G02F 1/136286
USPC ..... 345/87, 95, 204, 211, 690
See application file for complete search history.

(56) References Cited

U.S. PATENT DOCUMENTS

| | | | | |
|---|---|---|---|---|
| 8,009,132 | B2 | 8/2011 | Shin et al. | |
| 9,293,106 | B2 | 3/2016 | Hong et al. | |
| 9,530,350 | B2 | 12/2016 | Cho et al. | |
| 9,715,861 | B2 | 7/2017 | Kim et al. | |
| 9,818,356 | B2 | 11/2017 | Won et al. | |
| 9,865,217 | B2 | 1/2018 | Won et al. | |
| 9,934,737 | B2 | 4/2018 | Jung et al. | |
| 10,269,312 | B2 | 4/2019 | Hwang et al. | |
| 2004/0046718 | A1* | 3/2004 | Osame | G09G 3/3275 345/80 |

(Continued)

FOREIGN PATENT DOCUMENTS

| | | | |
|---|---|---|---|
| CN | 1920932 | A | 2/2007 |
| CN | 103996383 | A | 8/2014 |

(Continued)

*Primary Examiner* — Jennifer T Nguyen
(74) *Attorney, Agent, or Firm* — Innovation Counsel LLP

(57) ABSTRACT

A display apparatus includes a display panel, a gate driver and a data driver. The display panel is configured to display an image. The gate driver is configured to output a gate signal to the display panel. The data driver is configured to output a data voltage to the display panel. The display panel includes a first subpixel row including first subpixels having a first color and a second subpixel row including second subpixels having a second color. A first gate off voltage of a first gate signal applied to the first subpixel row to turn off switching elements of the first subpixel row is different from a second gate off voltage of a second gate signal applied to the second subpixel row to turn off switching elements of the second subpixel row.

28 Claims, 19 Drawing Sheets

(56) References Cited

U.S. PATENT DOCUMENTS

| | | | | |
|---|---|---|---|---|
| 2008/0150868 | A1* | 6/2008 | Chen | G09G 3/364 345/95 |
| 2008/0224986 | A1 | 9/2008 | Huang et al. | |
| 2010/0141643 | A1* | 6/2010 | Li | G09G 3/3648 345/214 |
| 2012/0307174 | A1* | 12/2012 | Lee | G09G 3/3677 349/54 |
| 2013/0044096 | A1 | 2/2013 | Kim et al. | |
| 2014/0313181 | A1* | 10/2014 | Hong | G09G 3/2003 345/212 |
| 2015/0279272 | A1* | 10/2015 | Takahara | G09G 3/3233 345/76 |
| 2015/0302816 | A1* | 10/2015 | Won | G09G 3/3685 345/87 |
| 2016/0210930 | A1* | 7/2016 | Lee | G09G 3/3685 |
| 2017/0154590 | A1 | 6/2017 | Ahn et al. | |
| 2018/0122310 | A1* | 5/2018 | Wang | G09G 3/36 |

FOREIGN PATENT DOCUMENTS

| | | | |
|---|---|---|---|
| CN | 105304032 | A | 2/2016 |
| CN | 106228937 | A | 12/2016 |
| JP | 2011-164580 | | 8/2011 |
| KR | 10-2003-0024993 | | 3/2003 |
| KR | 10-2007-0044596 | | 4/2007 |
| KR | 10-2013-0019776 | A | 2/2013 |
| KR | 10-1255705 | B1 | 4/2013 |
| KR | 10-2014-0097891 | A | 8/2014 |
| KR | 10-2014-0126148 | A | 10/2014 |
| KR | 10-2015-0121738 | A | 10/2015 |
| KR | 10-2016-0055368 | A | 5/2016 |
| KR | 10-2017-0064632 | A | 6/2017 |
| TW | 200837693 | A | 9/2008 |

* cited by examiner

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2017-0084501, filed on Jul. 3, 2017 in the Korean Intellectual Property Office KIPO, the contents of which are herein incorporated by reference in their entireties.

BACKGROUND

1. Field

Exemplary embodiments of the present inventive concept relate to a display apparatus and a method of driving a display panel using the display apparatus. More particularly, exemplary embodiments of the present inventive concept relate to a display apparatus applying gate signals varied according to colors of subpixels to improve a display quality and a method of driving a display panel using the display apparatus.

2. Description of the Related Art

Generally, a display apparatus includes a display panel and a display panel driver. The display panel includes a plurality of gate lines, a plurality of data lines and a plurality of subpixels.

The subpixel includes a switch and a subpixel electrode. The subpixel represents a color. For example, the subpixel may represent one of red, green and blue colors.

When the switch is deteriorated, a threshold voltage of the switch may be shifted. When the threshold voltage of the switch is shifted, a current flowing through the switch may be changed due to leakage current.

Due to the current leakage, the display panel may display an undesirable image.

SUMMARY

Exemplary embodiments of the present inventive concept provide a display apparatus applying gate signals varied according to colors of subpixels to improve a display quality.

Exemplary embodiments of the present inventive concept also provide a method of driving a display panel using the above-mentioned display apparatus.

In an exemplary embodiment of a display apparatus according to the present inventive concept, the display apparatus includes a display panel, a gate driver and a data driver. The display panel is configured to display an image. The gate driver is configured to output a gate signal to the display panel. The data driver is configured to output a data voltage to the display panel. The display panel includes a first subpixel row including first subpixels having a first color and a second subpixel row including second subpixels having a second color. A first gate off voltage of a first gate signal applied to the first subpixel row to turn off switching elements of the first subpixel row is different from a second gate off voltage of a second gate signal applied to the second subpixel row to turn off switching elements of the second subpixel row.

In an exemplary embodiment, a gate off voltage of a gate signal applied to a blue subpixel may be less than a gate off voltage of a gate signal applied to a subpixel which is not the blue subpixel.

In an exemplary embodiment, a gate off voltage of a gate signal applied to a green subpixel may be less than a gate off voltage of a gate signal applied to a red subpixel.

In an exemplary embodiment, a first gate on voltage of the first gate signal applied to the first subpixel row to turn on the switching elements of the first subpixel row may be different from a second gate on voltage of the second gate signal applied to the second subpixel row to turn on the switching elements of the second subpixel row.

In an exemplary embodiment, a gate on voltage of a gate signal applied to a blue subpixel may be less than a gate on voltage of a gate signal applied to a subpixel which is not the blue subpixel.

In an exemplary embodiment, a gate on voltage of a gate signal applied to a green subpixel may be less than a gate on voltage of a gate signal applied to a red subpixel.

In an exemplary embodiment, subpixel rows of the display panel may alternately display red, green and blue colors. The gate driver may be configured to generate gate signals alternately based on six gate clock signals having six different phases.

In an exemplary embodiment, first and seventh gate signals respectively applied to first and seventh subpixel rows may be generated based on a first gate clock signal having a gate on voltage and a first gate off voltage. Second and eighth gate signals respectively applied to second and eighth subpixel rows may be generated based on a second gate clock signal having the gate on voltage and a second gate off voltage different from the first gate off voltage. Third and ninth gate signals respectively applied to third and ninth subpixel rows may be generated based on a third gate clock signal having the gate on voltage and a third gate off voltage different from the first and second gate off voltages. Fourth and tenth gate signals respectively applied to fourth and tenth subpixel rows may be generated based on a fourth gate clock signal having the gate on voltage and the first gate off voltage. Fifth and eleventh gate signals respectively applied to fifth and eleventh subpixel rows may be generated based on a fifth gate clock signal having the gate on voltage and the second gate off voltage. Sixth and twelfth gate signals respectively applied to sixth and twelfth subpixel rows may be generated based on a sixth gate clock signal having the gate on voltage and the third gate off voltage.

In an exemplary embodiment, first and seventh gate signals respectively applied to first and seventh subpixel rows may be generated based on a first gate clock signal having a first gate on voltage and a first gate off voltage. Second and eighth gate signals respectively applied to second and eighth subpixel rows may be generated based on a second gate clock signal having a second gate on voltage different from the first gate on voltage and a second gate off voltage different from the first gate off voltage. Third and ninth gate signals respectively applied to third and ninth subpixel rows may be generated based on a third gate clock signal having a third gate on voltage different from the first and second gate on voltages and a third gate off voltage different from the first and second gate off voltages. Fourth and tenth gate signals respectively applied to fourth and tenth subpixel rows may be generated based on a fourth gate clock signal having the first gate on voltage and the first gate off voltage. Fifth and eleventh gate signals respectively applied to fifth and eleventh subpixel rows may be generated based on a fifth gate clock signal having the second gate on voltage and the second gate off voltage. Sixth and twelfth gate signals respectively applied to sixth and twelfth subpixel rows may be generated based on a sixth gate clock signal having the third gate on voltage and the third gate off voltage.

In an exemplary embodiment, subpixel rows of the display panel may alternately display red, green and blue colors. The gate driver may be configured to generate gate signals alternately based on twelve gate clock signals having twelve different phases.

In an exemplary embodiment, first, fourth, seventh and tenth gate signals respectively applied to first, fourth, seventh and tenth subpixel rows may be respectively generated based on first, fourth, seventh and tenth gate clock signals having a gate on voltage and a first gate off voltage. Second, fifth, eighth and eleventh gate signals respectively applied to second, fifth, eighth and eleventh subpixel rows may be respectively generated based on second, fifth, eighth and eleventh gate clock signals having the gate on voltage and a second gate off voltage different from the first gate off voltage. Third, sixth, ninth and twelfth gate signals respectively applied to third, sixth, ninth and twelfth subpixel rows may be respectively generated based on third, sixth, ninth and twelfth gate clock signals having the gate on voltage and a third gate off voltage different from the first and second gate off voltages.

In an exemplary embodiment, first, fourth, seventh and tenth gate signals respectively applied to first, fourth, seventh and tenth subpixel rows may be respectively generated based on first, fourth, seventh and tenth gate clock signals having a first gate on voltage and a first gate off voltage. Second, fifth, eighth and eleventh gate signals respectively applied to second, fifth, eighth and eleventh subpixel rows may be respectively generated based on second, fifth, eighth and eleventh gate clock signals having a second gate on voltage different from the first gate on voltage and a second gate off voltage different from the first gate off voltage. Third, sixth, ninth and twelfth gate signals respectively applied to third, sixth, ninth and twelfth subpixel rows may be respectively generated based on third, sixth, ninth and twelfth gate clock signals having a third gate on voltage different from the first and second gate on voltages and a third gate off voltage different from the first and second gate off voltages.

In an exemplary embodiment, subpixel rows of the display panel may alternately display red, green and blue colors. The gate driver may be configured to generate gate signals alternately based on four gate clock signals having four different phases.

In an exemplary embodiment, first, fifth and ninth gate signals respectively applied to first, fifth and ninth subpixel rows may be generated based on a first gate clock signal. Second, sixth and tenth gate signals respectively applied to second, sixth and tenth subpixel rows may be generated based on a second gate clock signal different from the first gate clock signal. Third, seventh and eleventh gate signals respectively applied to third, seventh and eleventh subpixel rows may be generated based on a third gate clock signal different from the first and second gate clock signals. Fourth, eighth and twelfth gate signals respectively applied to fourth, eighth and twelfth subpixel rows may be generated based on a fourth gate clock signal different from the first, second and third gate clock signals.

In an exemplary embodiment, each of the first to fourth gate clock signals sequentially may have a first gate on voltage, a first gate off voltage, a second gate on voltage, a second gate off voltage, a third gate on voltage and a third gate off voltage. The first gate on voltage, the second gate on voltage and the third gate on voltage may be different from one another, and a first gate off voltage, a second gate off voltage and a third gate off voltage are different from one another.

In an exemplary embodiment, each of the first to fourth gate clock signals may sequentially have a first gate on voltage a second gate on voltage and a third gate on voltage which are different from one another and a first gate off voltage a second gate off voltage and a third gate off voltage which are different from one another.

In an exemplary embodiment, each of the first gate off voltage and the second gate off voltage may be varied as time passes. A decrement of the first gate off voltage may be different from a decrement of the second gate off voltage.

In an exemplary embodiment, each of the first gate off voltage and the second gate off voltage may decrease as time passes.

In an exemplary embodiment, each of the first gate off voltage and the second gate off voltage may decrease until a predetermined time passed and then increase as time passes.

In an exemplary embodiment, the gate signal may have a main charge gate pulse and a precharge gate pulse prior to the main charge gate pulse.

In an exemplary embodiment, a gate signal applied to a lower portion of the display panel may be delayed than a gate signal applied to an upper portion of the display panel with respect to a load signal.

In an exemplary embodiment, a gate pulse of the gate signal may have a normal driving duration and an overdriving duration having a voltage level greater than a voltage level of the normal driving duration.

In an exemplary embodiment, a gate on voltage defining a high level of the gate signal may increase as time passes in a frame. A gate off voltage defining a low level of the gate signal may decrease as time passes in the frame.

In an exemplary embodiment of a method of driving a display panel according to the present inventive concept, the method includes outputting a gate signal to the display panel and outputting a data voltage to the display panel. The display panel includes a first subpixel row including first subpixels having a first color and a second subpixel row including second subpixels having a second color. A first gate off voltage of a first gate signal applied to the first subpixel row to turn off switching elements of the first subpixel row is different from a second gate off voltage of a second gate signal applied to the second subpixel row to turn off switching elements of the second subpixel row.

In an exemplary embodiment, the first color is a blue color and the second color may be a color other than the blue color. The first gate off voltage may be lower than the second gate off voltage.

In an exemplary embodiment, a first gate on voltage may be applied to the first subpixels and the second subpixels.

In an exemplary embodiment, the first gate on voltage may be lower than the second gate on voltage.

In an exemplary embodiment, the display panel may further include a third subpixel row including third subpixels having a third color, a third gate off voltage of a third gate signal being applied to the third subpixel row to turn off switching elements of the third subpixel row. The first color, the second color and the third color may be a blue color, a green color and a red color, respectively. The first gate off voltage may be lower than the second gate off voltage and the third gate off voltage, and the third gate off voltage may be higher than the second gate off voltage.

In an In an exemplary embodiment, a first gate on voltage may be applied to the first subpixels and the second subpixels.

In an In an exemplary embodiment, a first gate on voltage may be applied to the first subpixels and a second gate on voltage which is different from the first gate on voltage may be applied to the second subpixels.

According to the display apparatus and the method of driving the display panel using the display apparatus, the gate off voltage has the level varied according to the color of the subpixel. Accordingly, the deterioration of the switch which may be varied according to the color of the subpixel may be properly compensated. Thus, the display defect of the display panel due to the deterioration of the switch may be prevented so that the display quality of the display panel may be enhanced. In addition, the charging rate of the pixel voltage may be compensated to prevent the display defect of the display panel due to the insufficient charging rate of the pixel voltage so that the display quality of the display panel may be enhanced.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
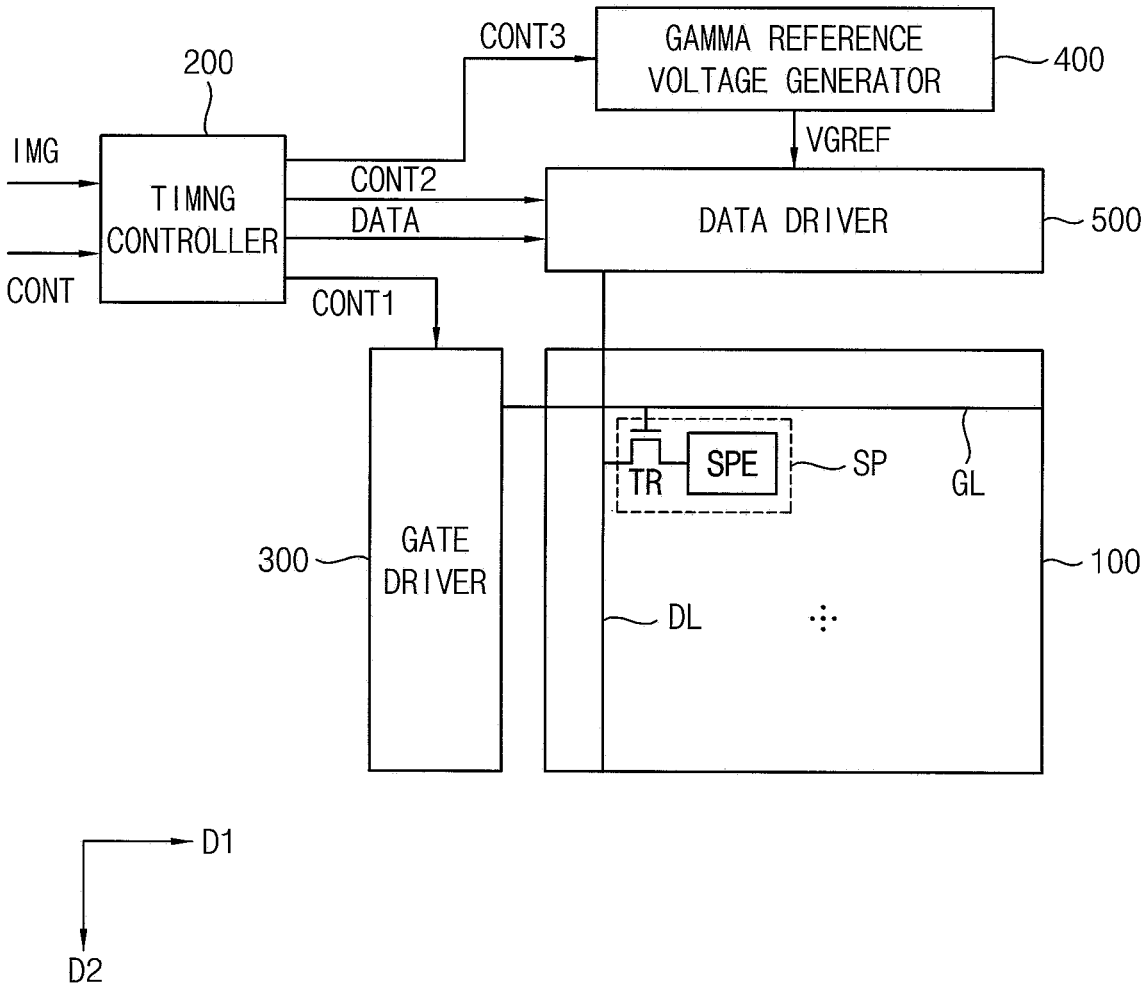
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL. The gate lines GL extend in a first direction D1 and the data lines DL extend in a second direction D2 crossing the first direction D1.

Each subpixel SP includes a switch TR and a subpixel electrode SPE electrically connected to the switch TR. The subpixels SP may be disposed in a matrix form.

The timing controller 200 receives input image data IMG and an input control signal CONT from an external apparatus (not shown). The input image data IMG may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 outputs the gate signals to the gate lines GL. Subpixels connected to a same gate line may represent a same color.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

Figure 2:
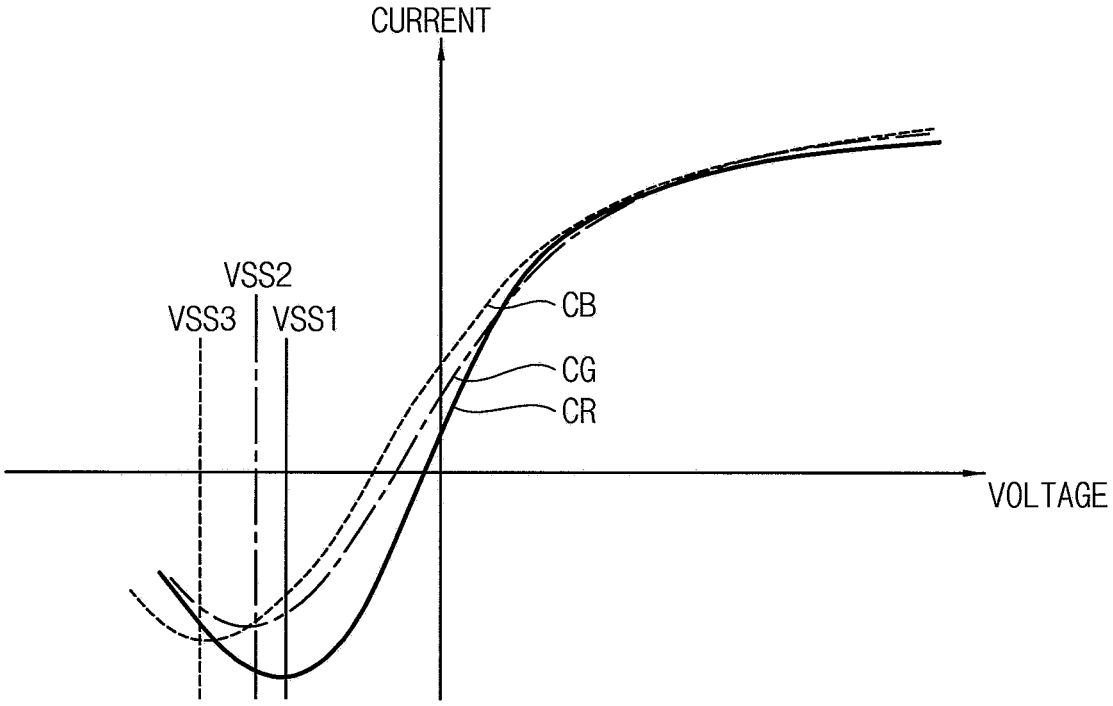
FIG. 2 is a graph illustrating current-voltage characteristics of a switch of a subpixel according to a color of the subpixel of a display panel of FIG. 1.

FIG. 2 is a graph illustrating current-voltage characteristics of the switch TR of the subpixel SP according to colors of the subpixels SP of the display panel 100 of FIG. 1.

Referring to FIGS. 1 and 2, the subpixel SP includes the switch TR and the subpixel electrode SPE. For example, the switch TR may be a thin film transistor.

The subpixel SP represents a color. For example, the subpixel may represent one of red, green and blue colors. An energy intensity of an incident light and a reflective light to the switch TR may be varied according to the color of the subpixel.

Thus, the deterioration of the switch TR may be varied according to the color of the subpixel. When the switch TR is deteriorated, a threshold voltage of the switch TR may be shifted. When the threshold voltage of the switch TR is shifted, a current flowing through the switch TR may be changed due to leakage current.

Due to the leakage current, the display panel 100 may display an undesirable image. For example, when the switch TR of a blue subpixel is deteriorated and the current flowing through the switch TR of the blue subpixel is leaked, the display panel 100 may display a yellowish image.

FIG. 2 represents the characteristics of an output current according to an input voltage of the switch TR which is deteriorated due to long operating time of the display apparatus. For example, the input voltage may be a gate source voltage of the thin film transistor TR. The output current may be a drain current of the thin film transistor TR.

A first curve CR represents a current-voltage characteristic of the switch TR of a red subpixel, a second curve CG represents a current-voltage characteristics of the switch TR of a green subpixel and a third curve CB represents a current-voltage characteristic of the switch TR of a blue subpixel.

As shown in FIG. 2, the deterioration of the switch TR of the subpixel SP may be varied according to the color of the subpixel SP. When the specific color among red, green and blue may be stronger or weaker due to the difference of the deterioration of the switch TR, the display quality of the display panel 100 may be deteriorated.

Figure 3:
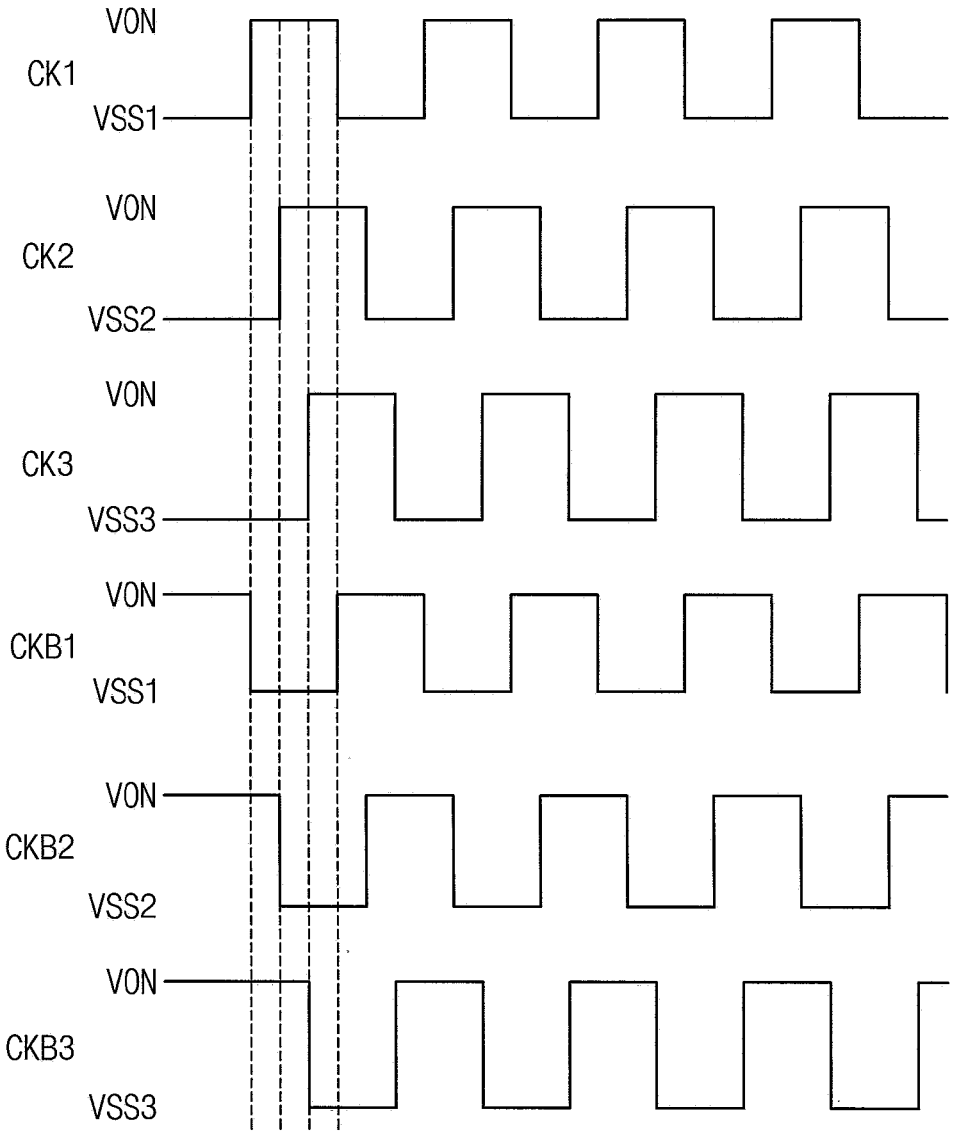
FIG. 3 is a timing diagram illustrating a gate clock signal to generate a gate signal of FIG. 1.
Figure 4:
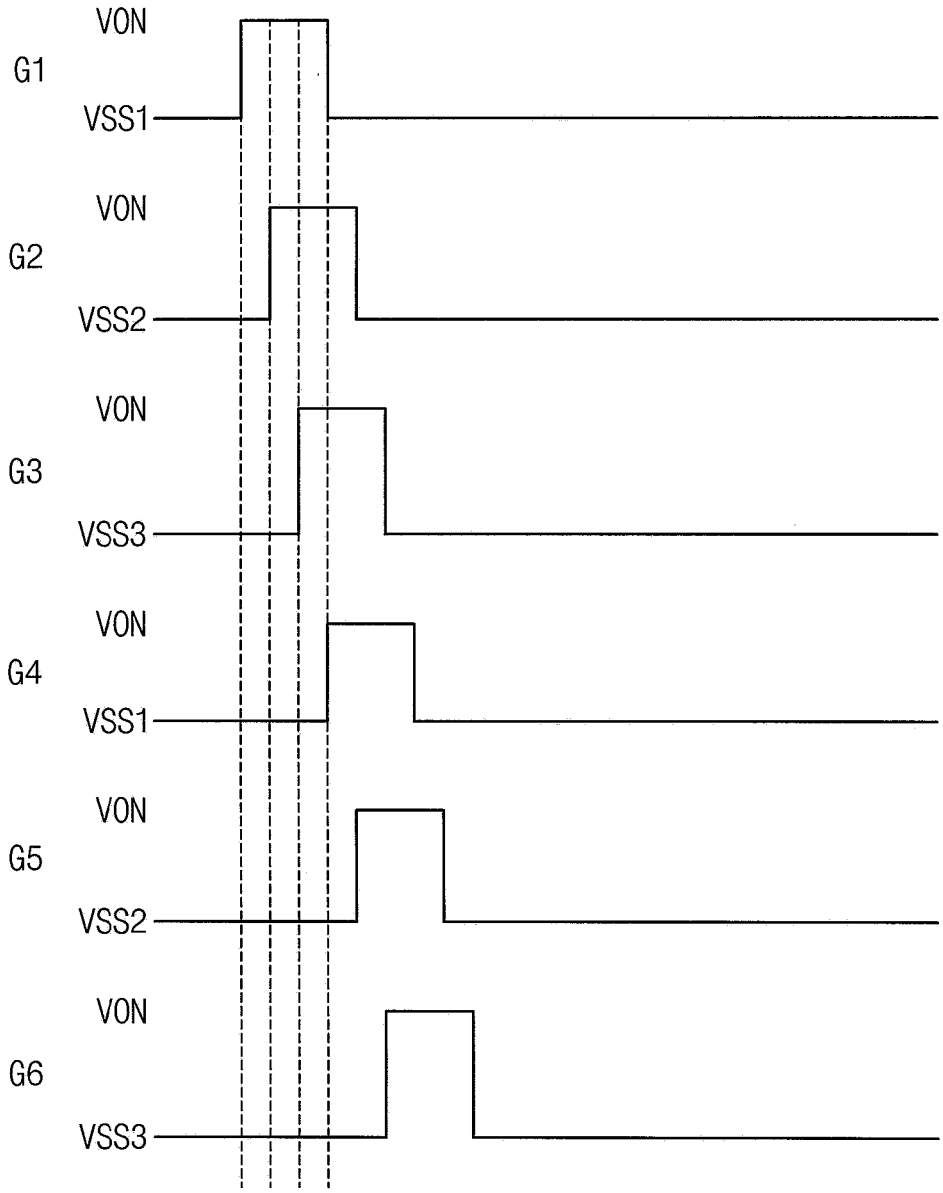
FIG. 4 is a timing diagram illustrating the gate signal generated based on the gate clock signal of FIG. 3.
Figure 5:
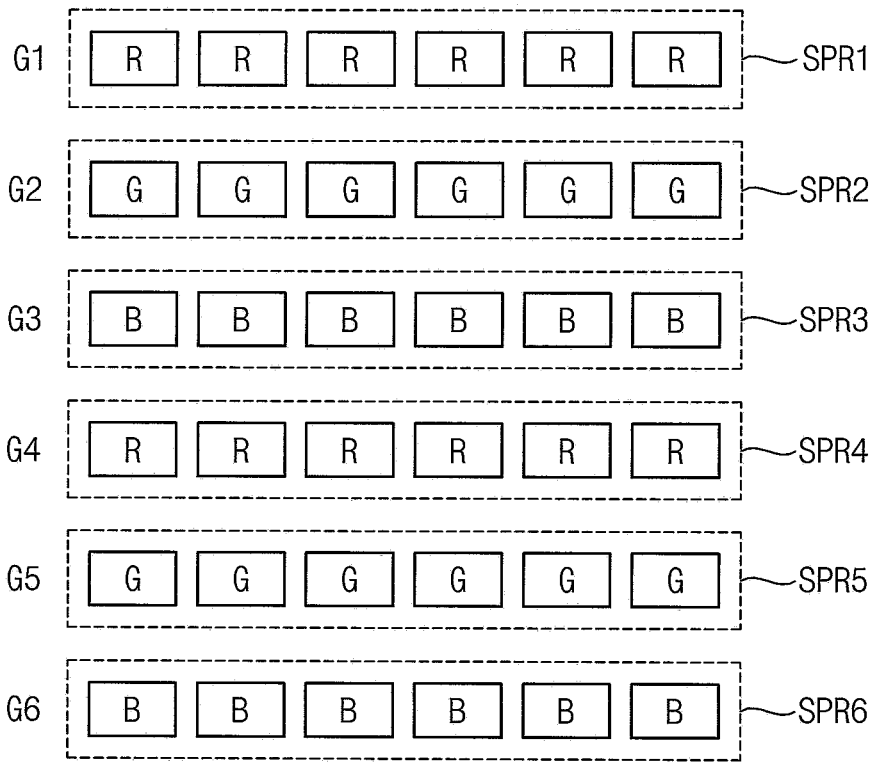
FIG. 5 is a conceptual diagram illustrating a pixel structure of the display panel of FIG. 1 to which the gate signal of FIG. 4 is applied.

FIG. 3 is a timing diagram illustrating a gate clock signal CK1 to CK3 and CKB1 to CKB3 to generate a gate signal of FIG. 1. FIG. 4 is a timing diagram illustrating the gate signal G1 to G6 generated based on the gate clock signal CK1 to CK3 and CKB1 to CKB3 of FIG. 3. FIG. 5 is a conceptual diagram illustrating a pixel structure of the display panel 100 of FIG. 1 to which the gate signal G1 to G6 of FIG. 4 is applied.

Referring to FIGS. 1 to 5, subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels.

A first gate signal G1 may be applied to the first subpixel row SPR1. A second gate signal G2 may be applied to the second subpixel row SPR2. A third gate signal G3 may be applied to the third subpixel row SPR3. A fourth gate signal G4 may be applied to the fourth subpixel row SPR4. A fifth gate signal G5 may be applied to the fifth subpixel row SPR5. A sixth gate signal G6 may be applied to the sixth subpixel row SPR6.

The gate driver 300 may generate the gate signals G1 to G6 alternately based on six gate clock signals CK1 to CK3 and CKB1 to CKB3 having six different phases.

The first gate signal G1 may be generated based on a first gate clock signal CK1. The second gate signal G2 may be generated based on a second gate clock signal CK2. The third gate signal G3 may be generated based on a third gate clock signal CK3. The fourth gate signal G4 may be generated based on a fourth gate clock signal CKB1. The fifth gate signal G5 may be generated based on a fifth gate clock signal CKB2. The sixth gate signal G6 may be generated based on a sixth gate clock signal CKB3.

In a similar way, a seventh gate signal applied to a seventh subpixel row may be generated based on the first gate clock signal CK1. An eighth gate signal applied to an eighth subpixel row may be generated based on the second gate clock signal CK2. A ninth gate signal applied to a ninth subpixel row may be generated based on the third gate clock signal CK3. A tenth gate signal applied to a tenth subpixel row may be generated based on the fourth gate clock signal CKB1. An eleventh gate signal applied to an eleventh subpixel row may be generated based on the fifth gate clock signal CKB2. A twelfth gate signal applied to a twelfth subpixel row may be generated based on the sixth gate clock signal CKB3.

The gate clock signal CK1 to CK3 and CKB1 to CKB3 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals have the same gate on voltages and different gate off voltages. Although not shown in figures, the gate on voltage and the gate off voltage may be generated by a power voltage generator and outputted from the power voltage generator to the gate driver 300. Alternatively, the gate on voltage and the gate off voltage may be generated by the power voltage generator and outputted from the power voltage generator to the gate driver 300 via the timing controller 200. Alternatively, the gate on voltage and the gate off voltage may be generated in the gate driver 300.

For example, the first gate clock signal CK1 may have a gate on voltage VON and a first gate off voltage VSS1. The second gate clock signal CK2 may have the gate on voltage VON and a second gate off voltage VSS2 different from the first gate off voltage VSS1. The third gate clock signal CK3 may have the gate on voltage VON and a third gate off voltage VSS3 different from the first gate off voltage VSS1 and the second gate off voltage VSS2. For example, the fourth gate clock signal CKB1 may have the gate on voltage VON and the first gate off voltage VSS1. The fifth gate clock signal CKB2 may have the gate on voltage VON and the second gate off voltage VSS2. The sixth gate clock signal CKB3 may have the gate on voltage VON and the third gate off voltage VSS3.

For example, the gate off voltage VSS3 of the gate signals G3 and G6 outputted to the blue subpixel row may be less than the gate off voltages VSS1 and VSS2 of the gate signals G1, G2, G4 and G5 outputted to the subpixel rows which are not the blue subpixel row.

For example, the gate off voltage VSS2 of the gate signals G2 and G5 outputted to the green subpixel row may be less than the gate off voltage VSS1 of the gate signals G1 and G4 outputted to the red subpixel row.

Referring again to FIG. 2, the deterioration (e.g. the shift of the threshold voltage) of the switch of the red subpixel is less than the deterioration of the switching elements of the green subpixel and the blue subpixel. The deterioration (e.g. the shift of the threshold voltage) of the switch of the blue subpixel is greater than the deterioration of the switching elements of the red subpixel and the green subpixel. Therefore, if the gate off voltage determining the turn-off of the switch of the red subpixel is increased and the gate off voltage determining the turn-off of the switch of the blue subpixel is decreased, the difference of the deterioration of the switch according to the color of the subpixel may be compensated.

According to the present exemplary embodiment, the gate off voltage of the gate signal applied to the subpixel may vary according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 6:
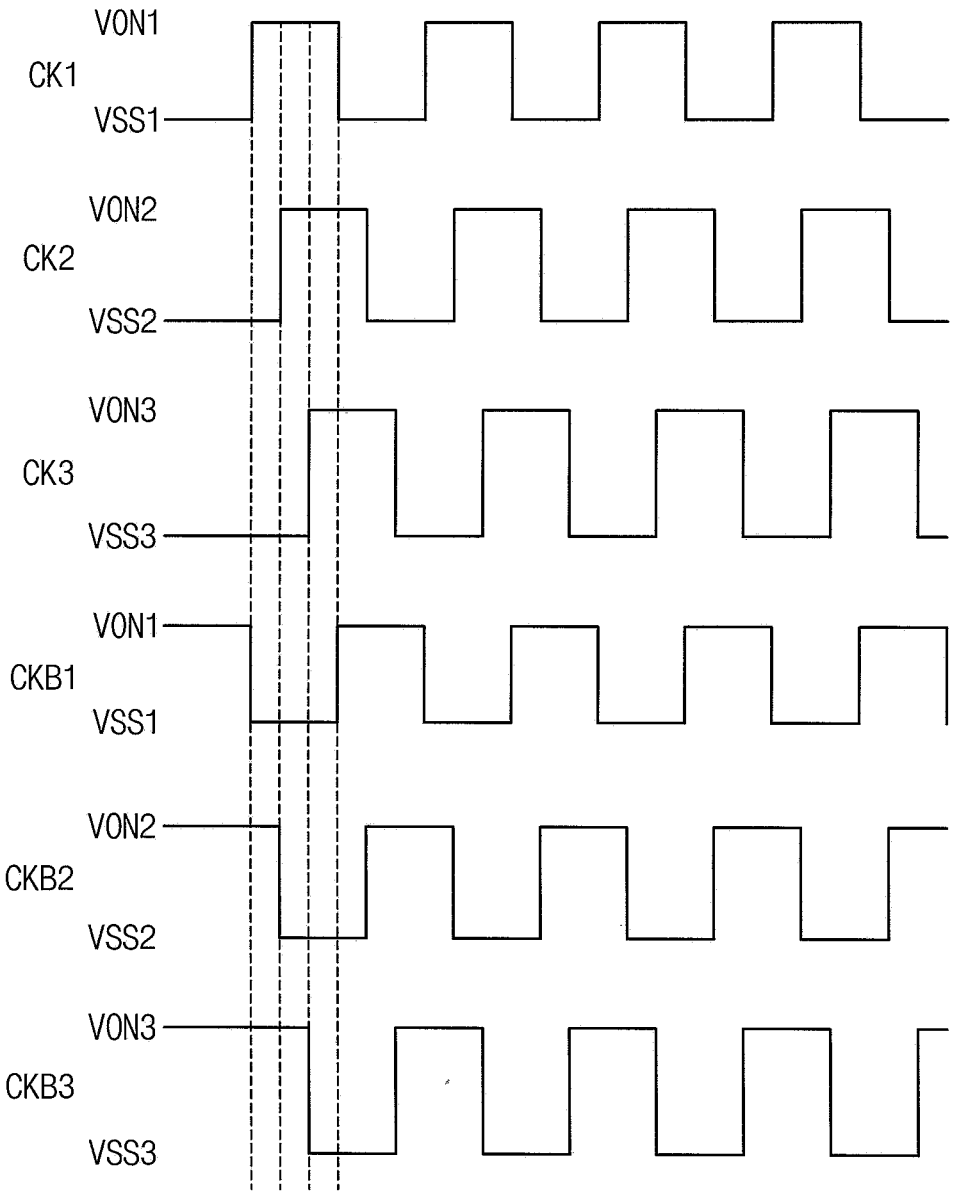
FIG. 6 is a timing diagram illustrating a gate clock signal to generate a gate signal according to an exemplary embodiment.

FIG. 6 is a timing diagram illustrating a gate clock signal to generate a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except for the level of the gate on voltage. Thus, the same reference numerals will be used to refer to the same or like parts as those described in the previous exemplary embodiment of FIGS. 1 to 5 and any repetitive explanation concerning the above elements will be omitted.

Referring to FIGS. 1, 2, 5 and 6, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

Subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels.

The gate driver 300 may generate the gate signals alternately based on six gate clock signals CK1 to CK3 and CKB1 to CKB3 having six different phases.

The gate clock signal CK1 to CK3 and CKB1 to CKB3 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals have different gate on voltages and different gate off voltages.

For example, the first gate clock signal CK1 may have a first gate on voltage VON1 and a first gate off voltage VSS1. The second gate clock signal CK2 may have a second gate on voltage VON2 different from the first gate on voltage VON1 and a second gate off voltage VSS2 different from the first gate off voltage VSS1. The third gate clock signal CK3 may have a third gate on voltage VON3 different from the first gate on voltage VON1 and the second gate on voltage VON2, and a third gate off voltage VSS3 different from the first gate off voltage VSS1 and the second gate off voltage VSS2. For example, the fourth gate clock signal CKB1 may have the first gate on voltage VON1 and the first gate off voltage VSS1. The fifth gate clock signal CKB2 may have the second gate on voltage VON2 and the second gate off voltage VSS2. The sixth gate clock signal CKB3 may have the third gate on voltage VON3 and the third gate off voltage VSS3.

For example, the gate off voltage VSS3 of the gate signals G3 and G6 outputted to the blue subpixel row may be less than the gate off voltages VSS1 and VSS2 of the gate signals G1, G2, G4 and G5 outputted to the subpixel rows which are not the blue subpixel row.

For example, the gate off voltage VSS2 of the gate signals G2 and G5 outputted to the green subpixel row may be less than the gate off voltage VSS1 of the gate signals G1 and G4 outputted to the red subpixel row.

Accordingly, the difference of the deterioration of the switch TR according to the color of the subpixel may be compensated.

For example, the gate on voltage VON3 of the gate signals G3 and G6 outputted to the blue subpixel row may be less than the gate on voltages VON1 and VON2 of the gate signals G1, G2, G4 and G5 outputted to the subpixel rows which are not the blue subpixel row.

For example, the gate on voltage VON2 of the gate signals G2 and G5 outputted to the green subpixel row may be less than the gate on voltage VON1 of the gate signals G1 and G4 outputted to the red subpixel row.

If kickback of the subpixel SP increases, level of a grayscale voltage is less than a desirable grayscale voltage when the grayscale voltage is applied to the subpixel electrode SPE. A degree of the kickback may be proportional to the difference between the gate on voltage and the gate off voltage.

In the exemplary embodiment explained referring to FIGS. 3 to 5, the gate on voltage may be the same regardless of the color of the subpixel and the gate off voltage may be set differently according to the color of the subpixel so that the kickback of the blue subpixel may be greater than that of the red subpixel and the green subpixel.

In the present exemplary embodiment, the low gate on voltage is applied to the subpixel having the low gate off voltage so that the difference of the kickback according to the color of the subpixel may be reduced. Thus, the display quality of the display panel 100 may be enhanced.

In addition, the degree of the kickback may be varied according to the color of the subpixel. Thus, the level of the gate on voltage may be properly adjusted based on the color of the subpixel and the level of the gate off voltage so that the difference of the kickback according to the color of the subpixel may be compensated.

Unlike the above explanation, according to the characteristics of the switch TR and the characteristics of the liquid crystal, the gate on voltage of the gate signal applied to the blue subpixel may be set to be greater than the gate on voltage of the gate signal applied to the subpixel which is not the blue subpixel.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch may be compensated so that the display quality of the display panel 100 may be enhanced.

In addition, the gate on voltage of the gate signal applied to the subpixel may be varied according to the color of the subpixel. Thus, the display defect of the display panel 100 due to the difference of the kickback according to the color of the subpixel may be prevented.

Figure 7:
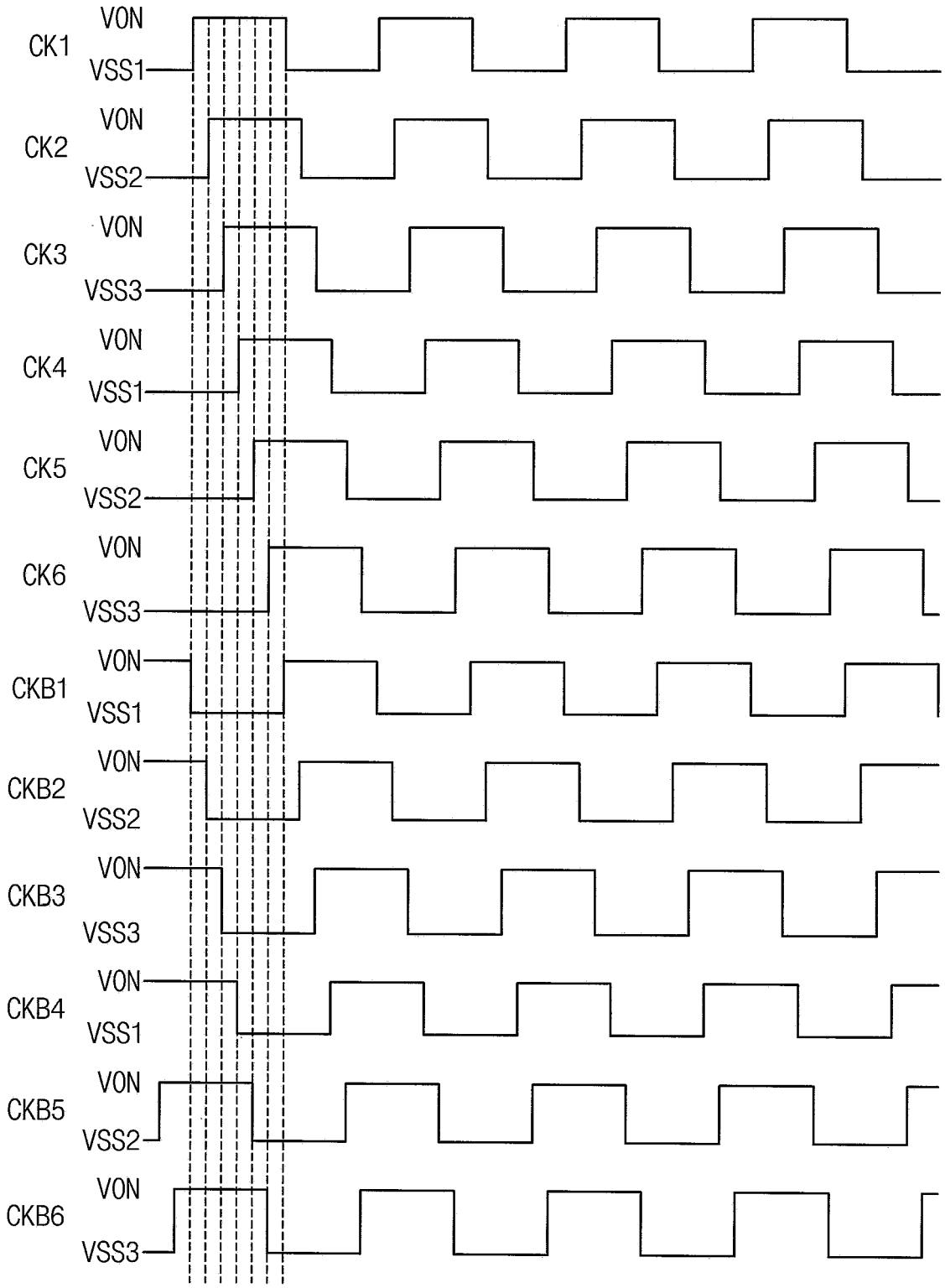
FIG. 7 is a timing diagram illustrating a gate clock signal to generate a gate signal according to an exemplary embodiment.
Figure 8:
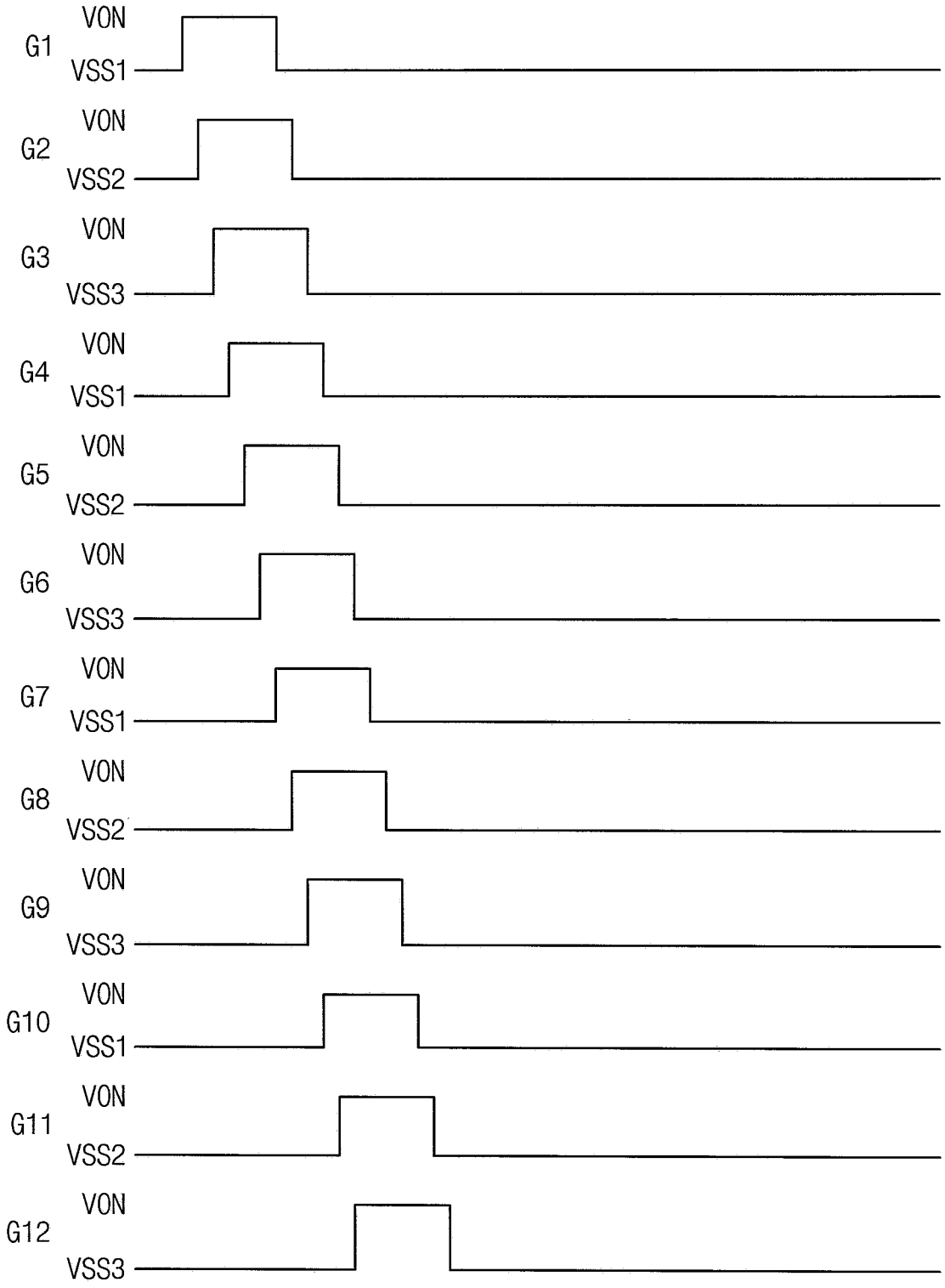
FIG. 8 is a timing diagram illustrating the gate signal generated based on the gate clock signal of FIG. 7.
Figure 9:
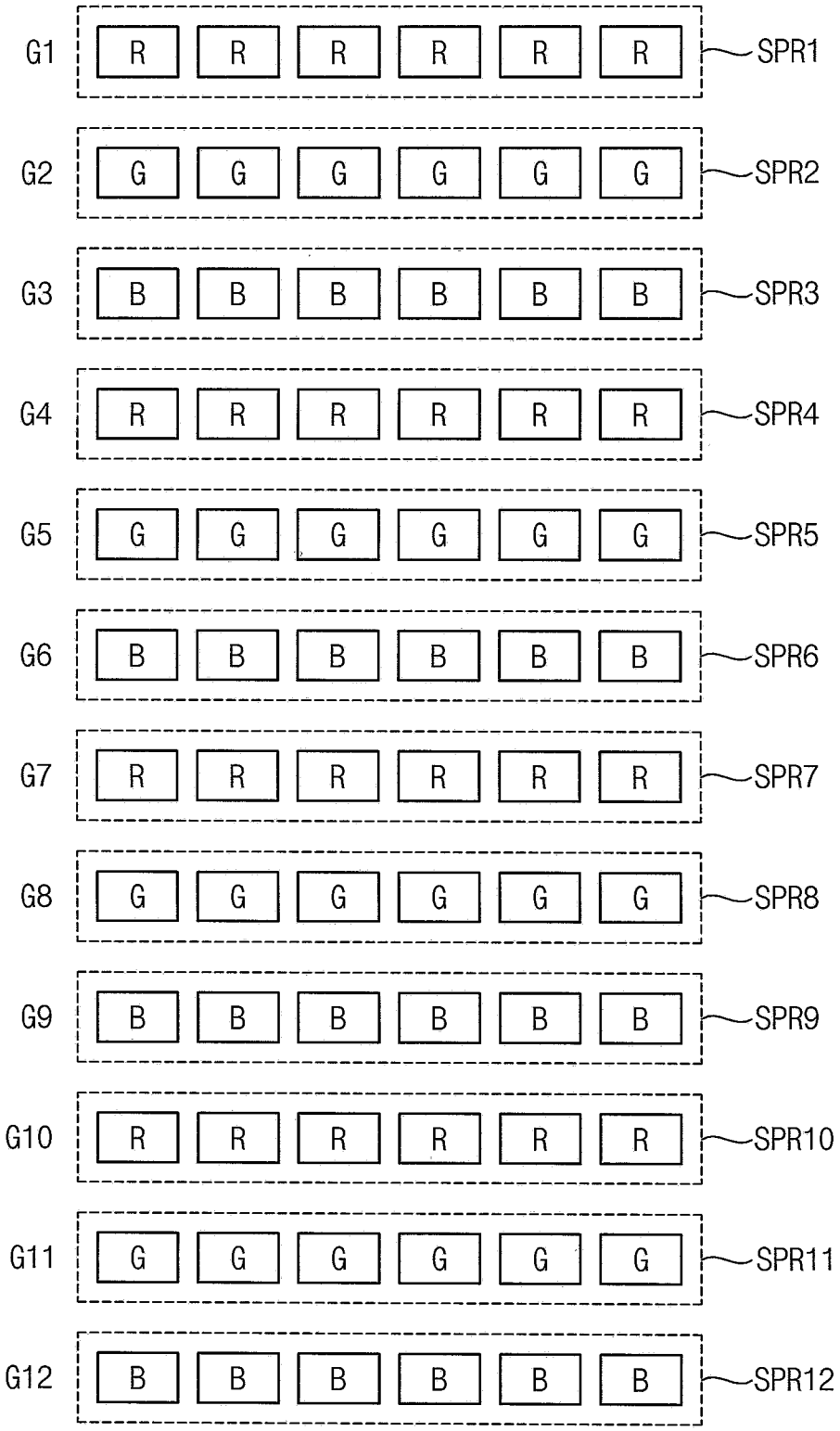
FIG. 9 is a conceptual diagram illustrating a pixel structure of a display panel to which the gate signal of FIG. 8 is applied.

FIG. 7 is a timing diagram illustrating a gate clock signal to generate a gate signal according to an exemplary embodiment. FIG. 8 is a timing diagram illustrating the gate signal generated based on the gate clock signal of FIG. 7. FIG. 9 is a conceptual diagram illustrating a pixel structure of a display panel to which the gate signal of FIG. 8 is applied.

The display apparatus and the method of driving the display panel according to the present exemplary embodiment is substantially the same as the display apparatus and the method of driving the display panel of the previous exemplary embodiment explained referring to FIGS. 1 to 5 except for the phases of the gate clock signals. Thus, the same reference numerals will be used to refer to the same or like parts as those described in the previous exemplary embodiment of FIGS. 1 to 5 and any repetitive explanation concerning the above elements will be omitted.

Referring to FIGS. 1, 2 and 7 to 9, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

Subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels. A seventh subpixel row SPR7 of the display panel 100 may include red subpixels. An eighth subpixel row SPR8 of the display panel 100 may include green subpixels. A ninth subpixel row SPR9 of the display panel 100 may include blue subpixels. A tenth subpixel row SPR10 of the display panel 100 may include red subpixels. An eleventh subpixel row SPR11 of the display panel 100 may include green subpixels. A twelfth subpixel row SPR12 of the display panel 100 may include blue subpixels.

A first gate signal G1 may be applied to the first subpixel row SPR1. A second gate signal G2 may be applied to the second subpixel row SPR2. A third gate signal G3 may be applied to the third subpixel row SPR3. A fourth gate signal G4 may be applied to the fourth subpixel row SPR4. A fifth gate signal G5 may be applied to the fifth subpixel row SPR5. A sixth gate signal G6 may be applied to the sixth subpixel row SPR6. A seventh gate signal G7 may be applied to the seventh subpixel row SPR7. An eighth gate signal G8 may be applied to the eighth subpixel row SPR8. A ninth gate signal G9 may be applied to the ninth subpixel row SPR9. A tenth gate signal G10 may be applied to the tenth subpixel row SPR10. An eleventh gate signal G11 may be applied to the eleventh subpixel row SPR11. A twelfth gate signal G12 may be applied to the twelfth subpixel row SPR12.

The gate driver 300 may generate the gate signals alternately based on twelve gate clock signals CK1 to CK6 and CKB1 to CKB6 having twelve different phases.

The first gate signal G1 may be generated based on a first gate clock signal CK1. The second gate signal G2 may be generated based on a second gate clock signal CK2. The third gate signal G3 may be generated based on a third gate clock signal CK3. The fourth gate signal G4 may be generated based on a fourth gate clock signal CK4. The fifth gate signal G5 may be generated based on a fifth gate clock signal CK5. The sixth gate signal G6 may be generated based on a sixth gate clock signal CK6. The seventh gate signal G7 may be generated based on a seventh gate clock signal CKB1. The eighth gate signal G8 may be generated based on an eighth gate clock signal CKB2. The ninth gate signal G9 may be generated based on a ninth gate clock signal CKB3. The tenth gate signal G10 may be generated based on a tenth gate clock signal CKB4. The eleventh gate signal G11 may be generated based on an eleventh gate clock signal CKB5. The twelfth gate signal G12 may be generated based on a twelfth gate clock signal CKB6.

The gate clock signal CK1 to CK6 and CKB1 to CKB6 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals have the same gate on voltages and different gate off voltages.

For example, the first gate clock signal CK1 may have a gate on voltage VON and a first gate off voltage VSS1. The second gate clock signal CK2 may have the gate on voltage VON and a second gate off voltage VSS2 different from the first gate off voltage VSS1. The third gate clock signal CK3 may have the gate on voltage VON and a third gate off voltage VSS3 different from the first gate off voltage VSS1 and the second gate off voltage VSS2. The fourth gate clock signal CK4 may have the gate on voltage VON and the first gate off voltage VSS1. The fifth gate clock signal CK5 may have the gate on voltage VON and the second gate off voltage VSS2. The sixth gate clock signal CK6 may have the gate on voltage VON and the third gate off voltage VSS3. The seventh gate clock signal CKB1 may have the gate on voltage VON and the first gate off voltage VSS1. The eighth gate clock signal CKB2 may have the gate on voltage VON and the second gate off voltage VSS2. The ninth gate clock signal CKB3 may have the gate on voltage VON and the third gate off voltage VSS3. The tenth gate clock signal CKB4 may have the gate on voltage VON and the first gate off voltage VSS1. The eleventh gate clock signal CKB5 may have the gate on voltage VON and the second gate off voltage VSS2. The twelfth gate clock signal CKB6 may have the gate on voltage VON and the third gate off voltage VSS3.

For example, the gate off voltage VSS3 of the gate signals G3, G6, G9 and G12 outputted to the blue subpixel row may be less than the gate off voltages VSS1 and VSS2 of the gate signals G1, G2, G4, G5, G7, G8, G10 and G11 outputted to the subpixel rows which are not the blue subpixel row.

For example, the gate off voltage VSS2 of the gate signals G2, G5, G8 and G11 outputted to the green subpixel row may be less than the gate off voltage VSS1 of the gate signals G1, G4, G7 and G10 outputted to the red subpixel row.

Referring again to FIG. 2, the deterioration (e.g. the shift of the threshold voltage) of the switch of the red subpixel is less than the deterioration of the switching elements of the green subpixel and the blue subpixel. The deterioration (e.g. the shift of the threshold voltage) of the switch of the blue subpixel is greater than the deterioration of the switching elements of the red subpixel and the green subpixel. Therefore, if the gate off voltage determining the turn-off of the switch TR of the red subpixel is increased and the gate off voltage determining the turn-off of the switch TR of the blue subpixel is decreased, the difference of the deterioration of the switch TR according to the color of the subpixel may be compensated.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 10:
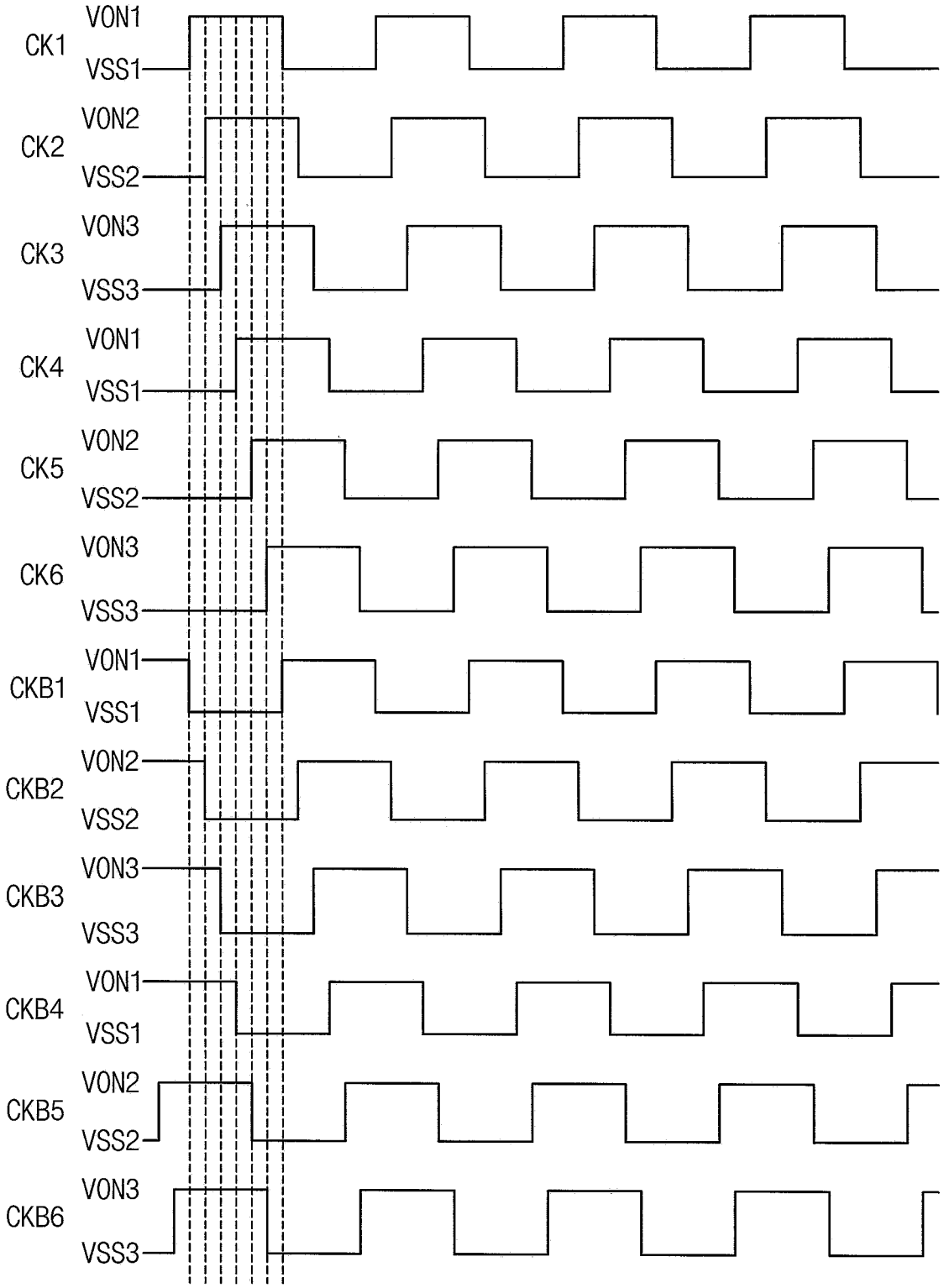
FIG. 10 is a timing diagram illustrating a gate clock signal to generate a gate signal according to an exemplary embodiment.

FIG. 10 is a timing diagram illustrating a gate clock signal to generate a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 7 to 9 except for the level of the gate on voltage. Thus, the same reference numerals will be used to refer to the same or like parts as those described in the previous exemplary embodiment of FIGS. 7 to 9 and any repetitive explanation concerning the above elements will be omitted.

Referring to FIGS. 1, 2, 9 and 10, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

Subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels. A seventh subpixel row SPR7 of the display panel 100 may include red subpixels. An eighth subpixel row SPR8 of the display panel 100 may include green subpixels. A ninth subpixel row SPR9 of the display panel 100 may include blue subpixels. A tenth subpixel row SPR10 of the display panel 100 may include red subpixels. An eleventh subpixel row SPR11 of the display panel 100 may include green subpixels. A twelfth subpixel row SPR12 of the display panel 100 may include blue subpixels.

The gate driver 300 may generate the gate signals alternately based on twelve gate clock signals CK1 to CK6 and CKB1 to CKB6 having twelve different phases.

The gate clock signal CK1 to CK6 and CKB1 to CKB6 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals have different gate on voltages and different gate off voltages.

For example, the first gate clock signal CK1 may have a first gate on voltage VON1 and a first gate off voltage VSS1. The second gate clock signal CK2 may have a second gate on voltage VON2 different from the first gate on voltage VON1 and a second gate off voltage VSS2 different from the first gate off voltage VSS1. The third gate clock signal CK3 may have a third gate on voltage VON3 different from the first gate on voltage VON1 and the second gate on voltage VON2, and a third gate off voltage VSS3 different from the first gate off voltage VSS1 and the second gate off voltage VSS2. For example, the fourth, seventh and tenth gate clock signal CK4, CKB1 and CKB4 may have the first gate on voltage VON1 and the first gate off voltage VSS1. The fifth, eighth and eleventh gate clock signal CK5, CKB2 and CKB5 may have the second gate on voltage VON2 and the second gate off voltage VSS2. The sixth, ninth and twelfth gate clock signal CK6, CKB3 and CKB6 may have the third gate on voltage VON3 and the third gate off voltage VSS3.

For example, the gate off voltage VSS3 of the gate signals G3, G6, G9 and G12 outputted to the blue subpixel row may be less than the gate off voltages VSS1 and VSS2 of the gate signals G1, G2, G4, G5, G7, G8, G10 and G11 outputted to the subpixel rows which are not the blue subpixel row.

For example, the gate off voltage VSS2 of the gate signals G2, G5, G8 and G11 outputted to the green subpixel row may be less than the gate off voltage VSS1 of the gate signals G1, G4, G7 and G10 outputted to the red subpixel row.

Accordingly, the difference of the deterioration of the switch TR according to the color of the subpixel may be compensated.

For example, the gate on voltage VON3 of the gate signals G3, G6, G9 and G12 outputted to the blue subpixel row may be less than the gate on voltages VON1 and VON2 of the gate signals G1, G2, G4, G5, G7, G8, G10 and G11 outputted to the subpixel rows which are not the blue subpixel row.

For example, the gate on voltage VON2 of the gate signals G2, G5, G8 and G11 outputted to the green subpixel row may be less than the gate on voltage VON1 of the gate signals G1, G4, G7 and G10 outputted to the red subpixel row.

If kickback of the subpixel SP increases, level of a grayscale voltage is less than a desirable grayscale voltage when the grayscale voltage is applied to the subpixel electrode SPE. A degree of the kickback may be proportional to the voltage difference between the gate on voltage and the gate off voltage.

In the exemplary embodiment explained referring to FIGS. 7 to 9, the gate on voltage may be the same regardless of the color of the subpixel and the gate off voltage may be set differently according to the color of the subpixel so that the kickback of the blue subpixel may be greater the that of the red pixel and the green pixel.

In the present exemplary embodiment, the low gate on voltage is applied to the subpixel having the low gate off voltage so that the difference of the kickback according to the color of the subpixel may be reduced. Thus, the display quality of the display panel 100 may be enhanced.

In addition, the degree of the kickback may be varied according to the color of the subpixel. Thus, the level of the gate on voltage may be properly adjusted based on the color of the subpixel and the level of the gate off voltage so that the difference of the kickback according to the color of the subpixel may be compensated.

Unlike the above explanation, according to the characteristics of the switch TR and the characteristics of the liquid crystal, the gate on voltage of the gate signal applied to the blue subpixel may be set to be greater than the gate on voltage of the gate signal applied to the subpixel which is not the blue subpixel.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

In addition, the gate on voltage of the gate signal applied to the subpixel may be varied according to the color of the subpixel. Thus, the display defect of the display panel 100 due to the difference of the kickback according to the color of the subpixel may be prevented.

Figure 11:
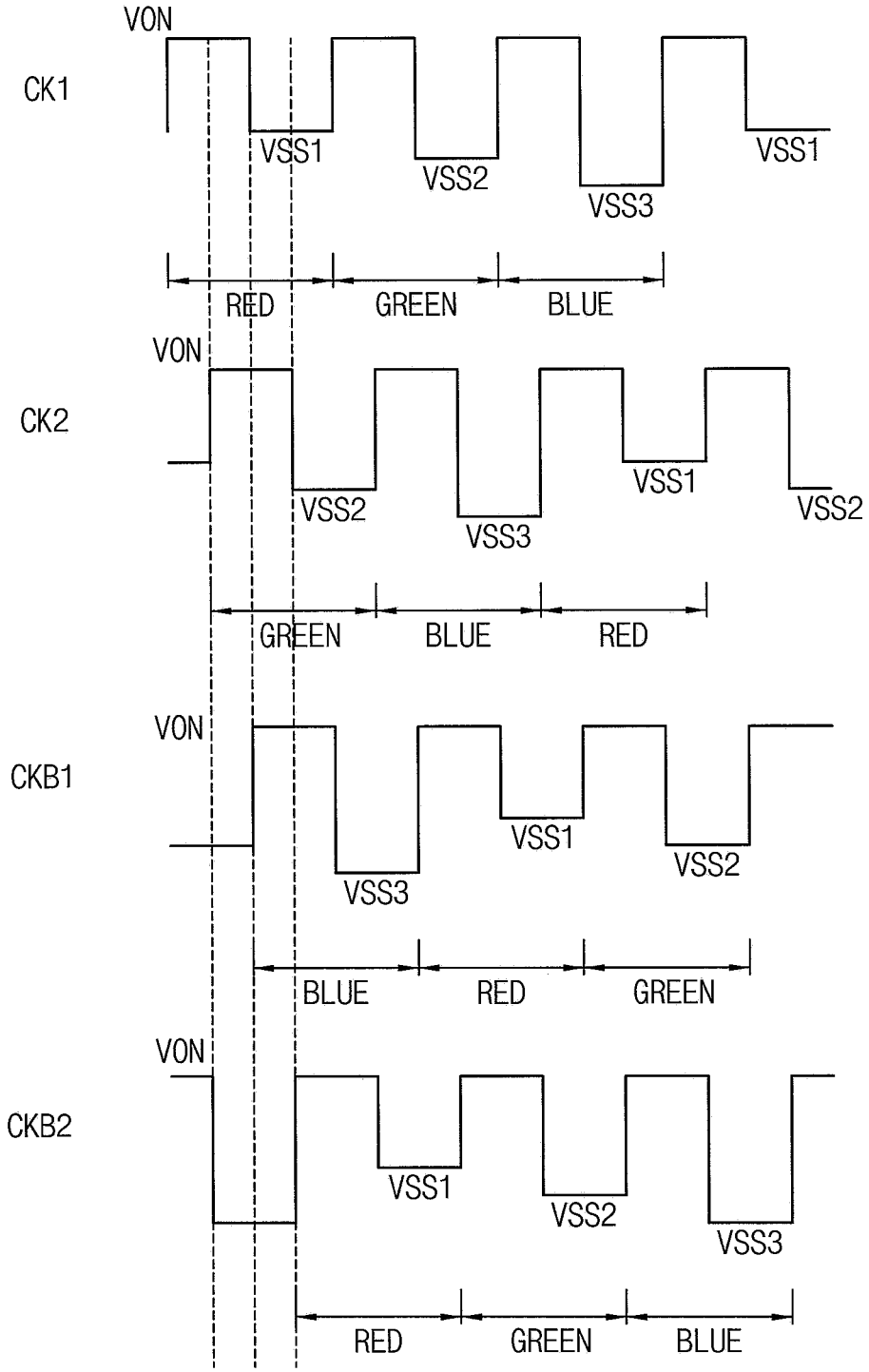
FIG. 11 is a timing diagram illustrating a gate clock signal to generate a gate signal according to an exemplary embodiment.
Figure 12:
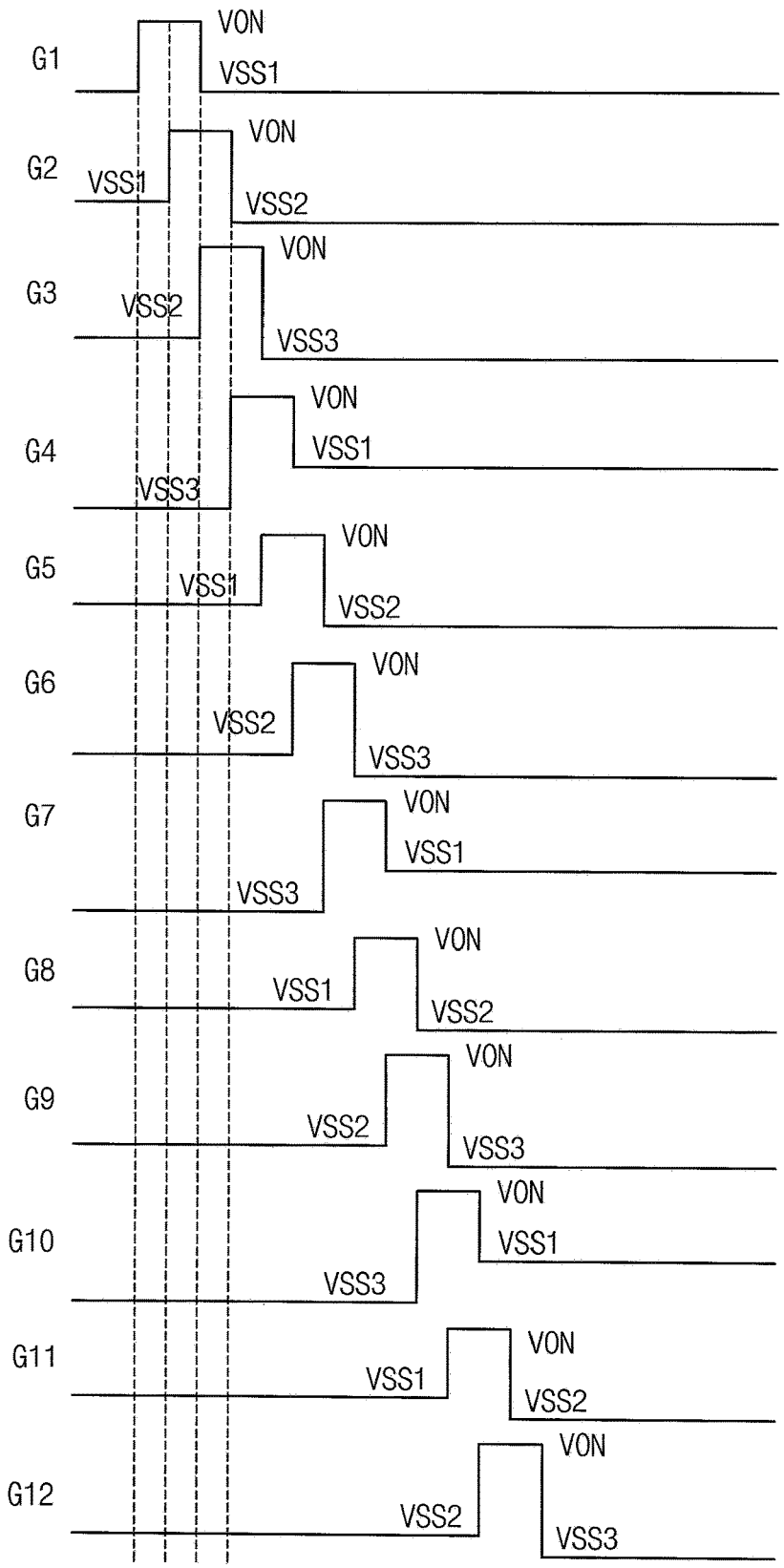
FIG. 12 is a timing diagram illustrating the gate signal generated based on the gate clock signal of FIG. 11.
Figure 13:
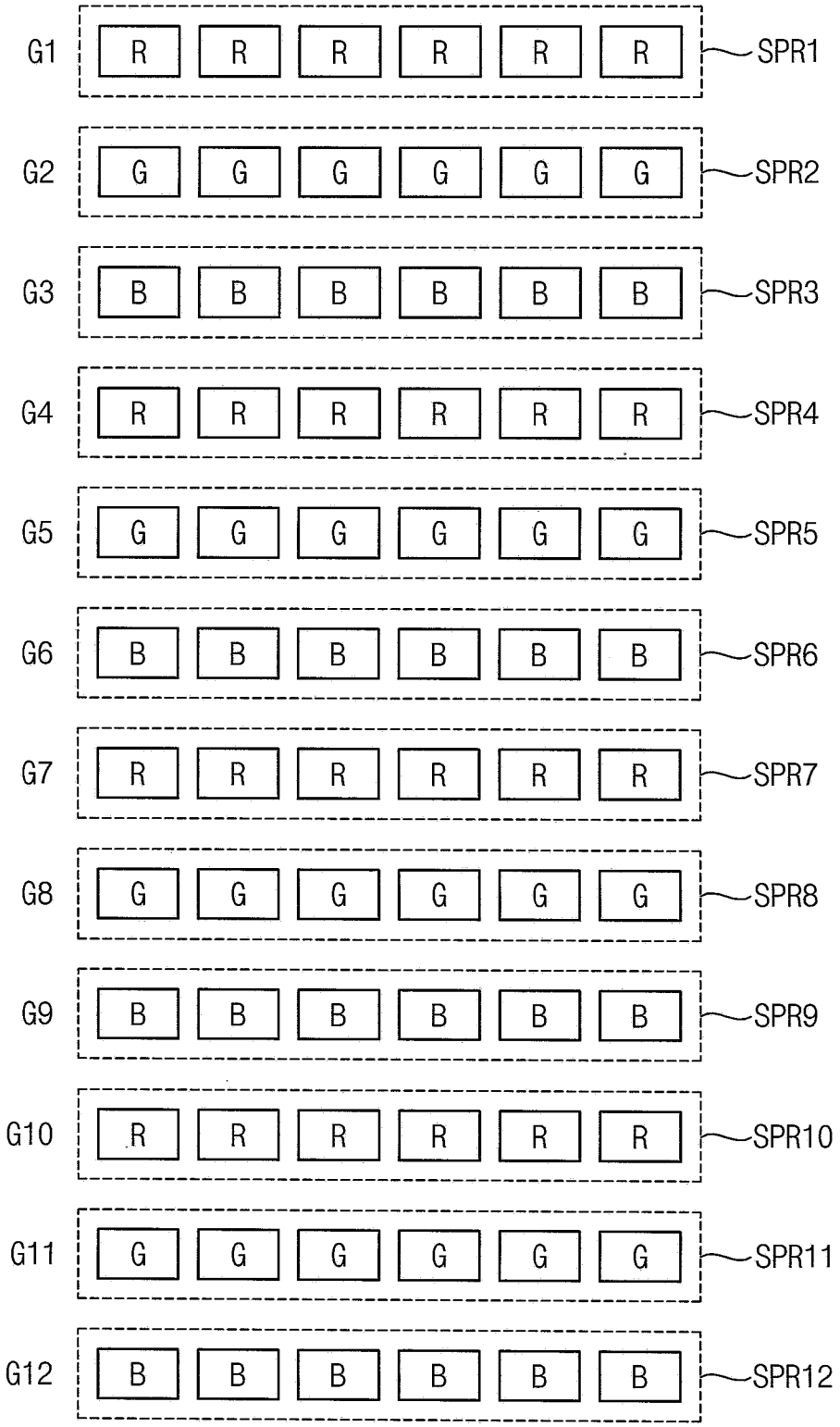
FIG. 13 is a conceptual diagram illustrating a pixel structure of a display panel to which the gate signal of FIG. 12 is applied.

FIG. 11 is a timing diagram illustrating a gate clock signal to generate a gate signal according to an exemplary embodiment. FIG. 12 is a timing diagram illustrating the gate signal generated based on the gate clock signal of FIG. 11. FIG. 13 is a conceptual diagram illustrating a pixel structure of a display panel to which the gate signal of FIG. 12 is applied.

The display apparatus and the method of driving the display panel according to the present exemplary embodiment is substantially the same as the display apparatus and the method of driving the display panel of the previous exemplary embodiment explained referring to FIGS. 1 to 5 except for the phases of the gate clock signals. Thus, the same reference numerals will be used to refer to the same or like parts as those described in the previous exemplary embodiment of FIGS. 1 to 5 and any repetitive explanation concerning the above elements will be omitted.

Referring to FIGS. 1, 2 and 11 to 13, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

Subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels. A seventh subpixel row SPR7 of the display panel 100 may include red subpixels. An eighth subpixel row SPR8 of the display panel 100 may include green subpixels. A ninth subpixel row SPR9 of the display panel 100 may include blue subpixels. A tenth subpixel row SPR10 of the display panel 100 may include red subpixels. An eleventh subpixel row SPR11 of the display panel 100 may include green subpixels. A twelfth subpixel row SPR12 of the display panel 100 may include blue subpixels.

A first gate signal G1 may be applied to the first subpixel row SPR1. A second gate signal G2 may be applied to the second subpixel row SPR2. A third gate signal G3 may be applied to the third subpixel row SPR3. A fourth gate signal G4 may be applied to the fourth subpixel row SPR4. A fifth gate signal G5 may be applied to the fifth subpixel row SPR5. A sixth gate signal G6 may be applied to the sixth subpixel row SPR6. A seventh gate signal G7 may be applied to the seventh subpixel row SPR7. An eighth gate signal G8 may be applied to the eighth subpixel row SPR8. A ninth gate signal G9 may be applied to the ninth subpixel row SPR9. A tenth gate signal G10 may be applied to the tenth subpixel row SPR10. An eleventh gate signal G11 may be applied to the eleventh subpixel row SPR11. A twelfth gate signal G12 may be applied to the twelfth subpixel row SPR12.

The gate driver 300 may generate the gate signals alternately based on four gate clock signals CK1, CK2, CKB1 and CKB2 having four different phases.

The first gate signal G1 may be generated based on a first gate clock signal CK1. The second gate signal G2 may be generated based on a second gate clock signal CK2. The third gate signal G3 may be generated based on a third gate clock signal CKB1. The fourth gate signal G4 may be generated based on a fourth gate clock signal CKB2. The fifth gate signal G5 may be generated based on the first gate clock signal CK1. The sixth gate signal G6 may be generated based on the second gate clock signal CK2. The seventh gate signal G7 may be generated based on the third gate clock signal CKB1. The eighth gate signal G8 may be generated based on the fourth gate clock signal CKB2. The ninth gate signal G9 may be generated based on the first gate clock signal CK1. The tenth gate signal G10 may be generated based on the second gate clock signal CK2. The eleventh gate signal G11 may be generated based on the third gate clock signal CKB1. The twelfth gate signal G12 may be generated based on the fourth gate clock signal CKB2.

The gate clock signal CK1, CK2, CKB1 and CKB2 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals CK1, CK2, CKB1 and CKB2 having the same gate on voltages and different gate off voltages.

For example, each of the first to fourth gate clock signals CK1, CK2, CKB1 and CKB2 may sequentially have a first gate off voltage VSS1, a second gate off voltage VSS2 and a third gate off voltage VSS3 which are different from one another.

For example, the first gate clock signal CK1 may generate a first gate signal applied to the red subpixels, a fifth gate signal applied to the green subpixels and a ninth gate signal applied to the blue subpixels.

For example, the second gate clock signal CK2 may generate a second gate signal applied to the green subpixels, a sixth gate signal applied to the blue subpixels and a tenth gate signal applied to the red subpixels.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 14:
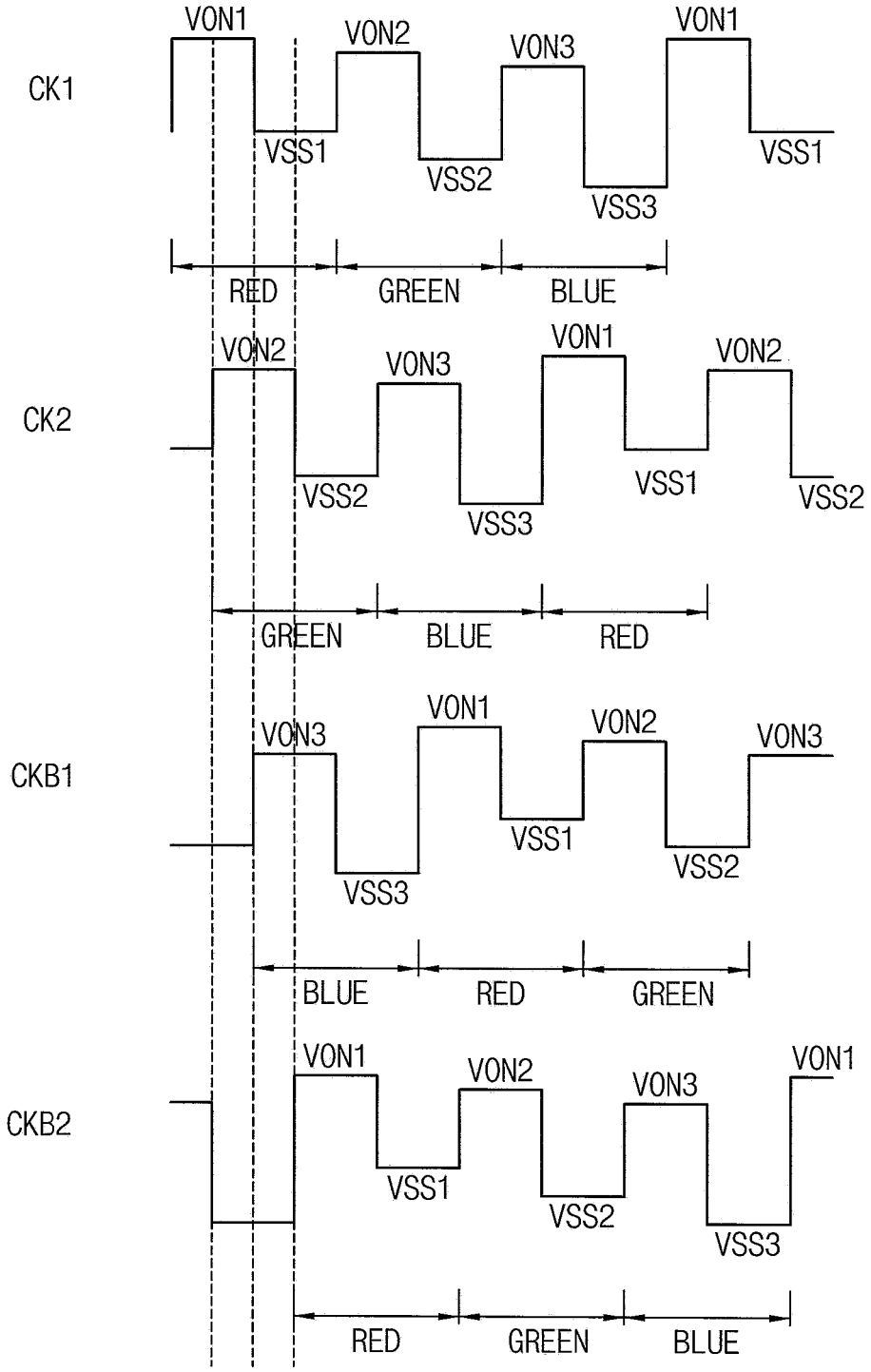
FIG. 14 is a timing diagram illustrating a gate clock signal to generate a gate signal according to an exemplary embodiment.

FIG. 14 is a timing diagram illustrating a gate clock signal to generate a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except for the phases of the gate clock signals. Thus, the same reference numerals will be used to refer to the same or like parts as those described in the previous exemplary embodiment of FIGS. 1 to 5 and any repetitive explanation concerning the above elements will be omitted.

Referring to FIGS. 1, 2, 13 and 14, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

Subpixel rows of the display panel 100 may alternately represent red, green and blue colors. A first subpixel row SPR1 of the display panel 100 may include red subpixels. A second subpixel row SPR2 of the display panel 100 may include green subpixels. A third subpixel row SPR3 of the display panel 100 may include blue subpixels. A fourth subpixel row SPR4 of the display panel 100 may include red subpixels. A fifth subpixel row SPR5 of the display panel 100 may include green subpixels. A sixth subpixel row SPR6 of the display panel 100 may include blue subpixels. A seventh subpixel row SPR7 of the display panel 100 may include red subpixels. An eighth subpixel row SPR8 of the display panel 100 may include green subpixels. A ninth subpixel row SPR9 of the display panel 100 may include blue subpixels. A tenth subpixel row SPR10 of the display panel 100 may include red subpixels. An eleventh subpixel row SPR11 of the display panel 100 may include green subpixels. A twelfth subpixel row SPR12 of the display panel 100 may include blue subpixels.

The gate driver 300 may generate the gate signals alternately based on four gate clock signals CK1, CK2, CKB1 and CKB2 having four different phases.

The first gate signal G1 may be generated based on a first gate clock signal CK1. The second gate signal G2 may be generated based on a second gate clock signal CK2. The third gate signal G3 may be generated based on a third gate clock signal CKB1. The fourth gate signal G4 may be generated based on a fourth gate clock signal CKB2. The fifth gate signal G5 may be generated based on the first gate clock signal CK1. The sixth gate signal G6 may be generated based on the second gate clock signal CK2. The seventh gate signal G7 may be generated based on the third gate clock signal CKB1. The eighth gate signal G8 may be generated based on the fourth gate clock signal CKB2. The ninth gate signal G9 may be generated based on the first gate clock signal CK1. The tenth gate signal G10 may be generated based on the second gate clock signal CK2. The eleventh gate signal G11 may be generated based on the third gate clock signal CKB1. The twelfth gate signal G12 may be generated based on the fourth gate clock signal CKB2.

The gate clock signal CK1, CK2, CKB1 and CKB2 has a gate on voltage and a gate off voltage. The gate on voltage may be defined as a voltage to turn on the switch TR. The gate off voltage may be defined as a voltage to turn off the switch TR. For example, the gate on voltage may be a high level voltage of the gate clock signal and the gate signal. The gate off voltage may be a low level voltage of the gate clock signal and the gate signal.

In the present exemplary embodiment, the gate clock signals CK1, CK2, CKB1 and CKB2 having different gate on voltages and different gate off voltages.

For example, each of the first to fourth gate clock signals CK1, CK2, CKB1 and CKB2 may sequentially have a first gate on voltage VON1, a first gate off voltage VSS1, a second gate on voltage VON2, a second gate off voltage VSS2 and a third gate on voltage VON3 and a third gate off voltage VSS3. The first gate off voltage VSS1, the second gate off voltage VSS2 and the third gate off voltage VSS3 may be different from one another, and a first gate off voltage VSS1, a second gate off voltage VSS2 and a third gate off voltage VSS3 may be different from one another.

For example, the first gate clock signal CK1 may generate a first gate signal applied to the red subpixels, a fifth gate signal applied to the green subpixels and a ninth gate signal applied to the blue subpixels.

For example, the second gate clock signal CK2 may generate a second gate signal applied to the green subpixels, a sixth gate signal applied to the blue subpixels and a tenth gate signal applied to the red subpixels.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

In addition, the gate on voltage of the gate signal applied to the subpixel may also be varied according to the color of the subpixel. Thus, the display defect of the display panel 100 due to the difference of the kickback according to the color of the subpixel may be prevented.

Figure 15:
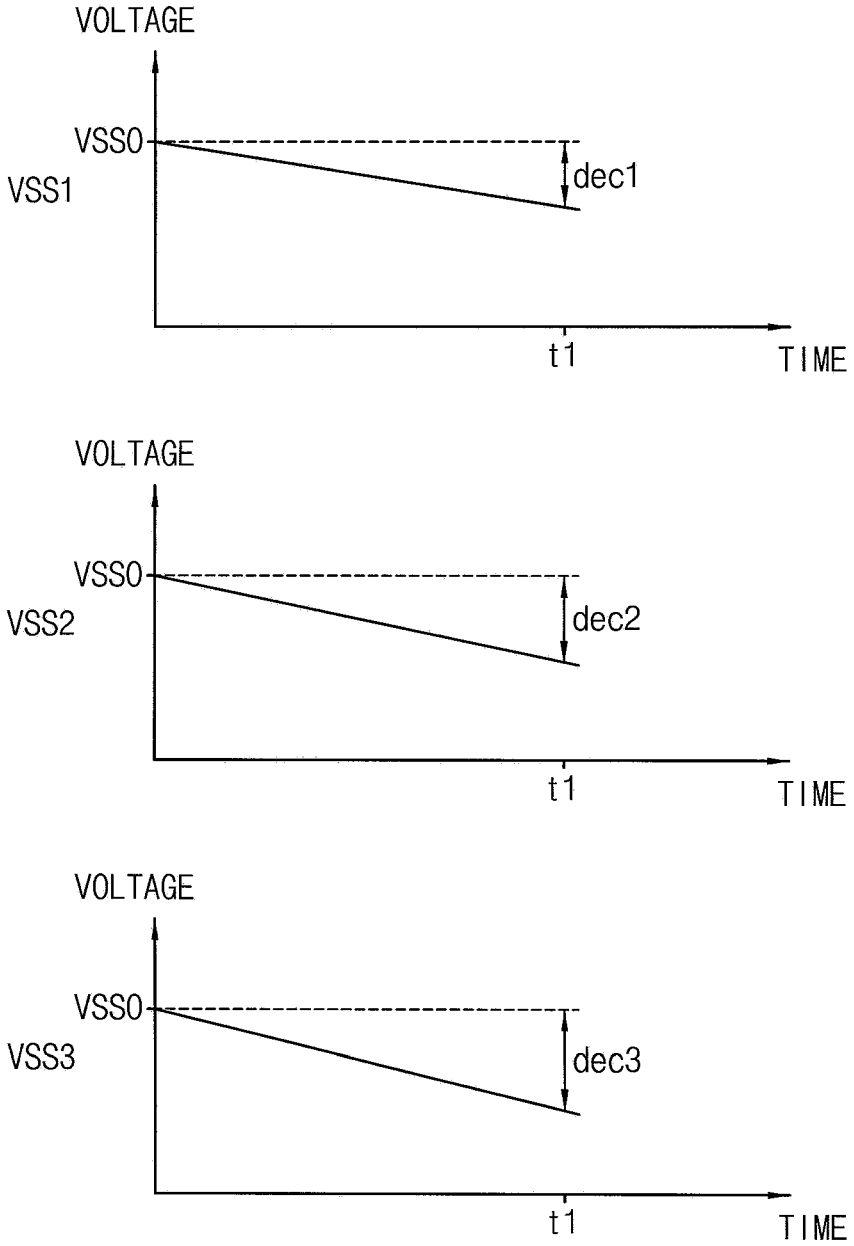
FIG. 15 is a timing diagram illustrating a gate off voltage to generate a gate signal according to an exemplary embodiment.

FIG. 15 is a timing diagram illustrating a gate off voltage to generate a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the gate off voltage decreases as time passes. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 15, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

FIG. 2 represents the deterioration of the switching elements of the red subpixel, the green subpixel and the blue subpixel as time passes. Thus, the gate off voltage may not have a fixed value but a varied value as time passes.

For example, the first gate off voltage VSS1 of the gate signal applied to the red subpixel may decrease from an initial gate off voltage VSS0 as time passes.

For example, the second gate off voltage VSS2 of the gate signal applied to the green subpixel may decrease from the initial gate off voltage VSS0 as time passes.

For example, the third gate off voltage VSS3 of the gate signal applied to the blue subpixel may decrease from the initial gate off voltage VSS0 as time passes.

The decrements of the first to third gate off voltages VSS1 to VSS3 may be different from one another. For example, a third decrement dec3 of the third gate off voltage VSS3 applied to the blue subpixel may be greater than a second decrement dec2 of the second gate off voltage VSS2 applied to the green subpixel. For example, the second decrement dec2 of the second gate off voltage VSS2 applied to the green subpixel may be greater than a first decrement dec1 of the first gate off voltage VSS1 applied to the red subpixel.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 16:
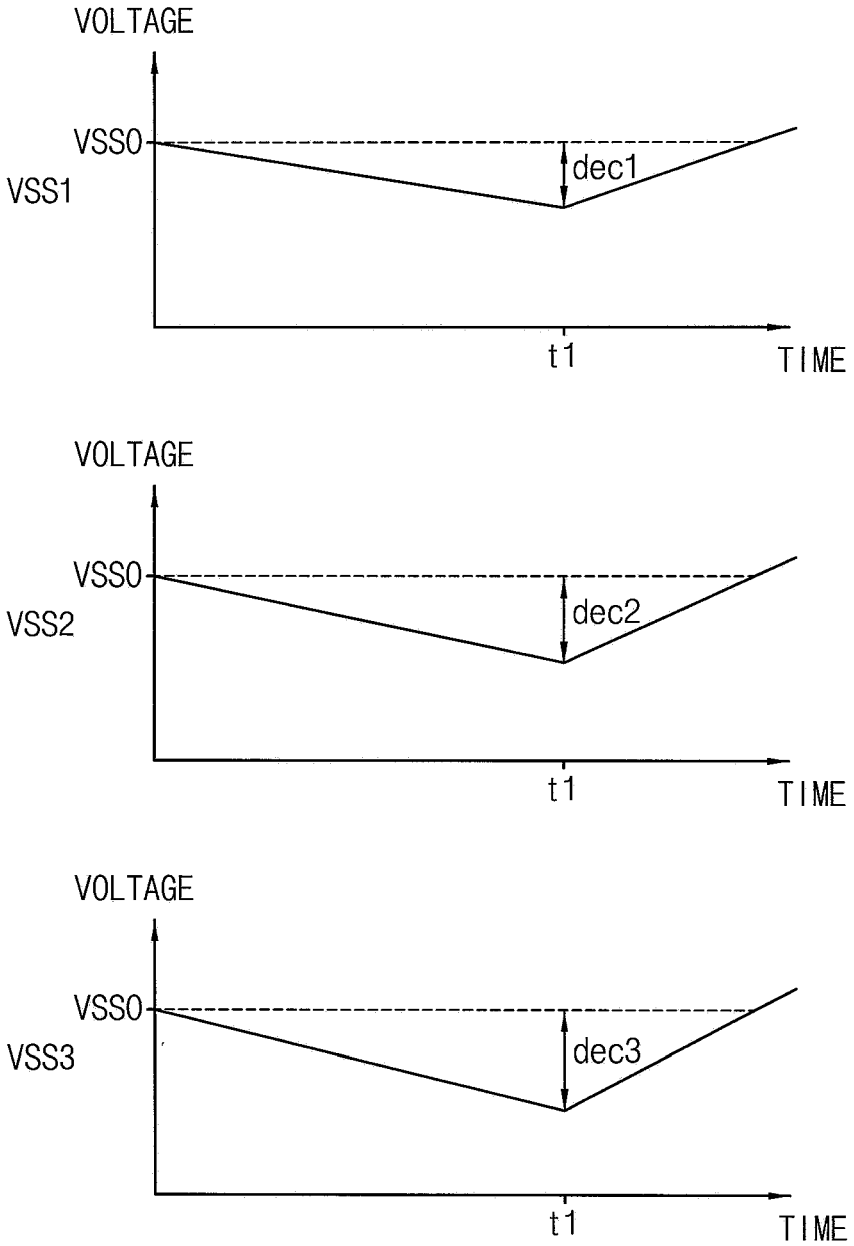
FIG. 16 is a timing diagram illustrating a gate off voltage to generate a gate signal according to an exemplary embodiment.

FIG. 16 is a timing diagram illustrating a gate off voltage to generate a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the gate off voltage decreases as time passes. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 16, the display apparatus includes the display panel 100 and the display panel driver. The display panel driver includes a timing controller 200, a gate driver 300, a gamma reference voltage generator 400 and a data driver 500.

The display panel 100 includes a plurality of gate lines GL, a plurality of data lines DL and a plurality of subpixels SP electrically connected to the gate lines GL and the data lines DL.

Each subpixel SP includes a switch TR and a subpixel electrode SPE electrically connected to the switch TR. The subpixels SP may be disposed in a matrix form.

FIG. 2 represents the deterioration of the switching elements of the red subpixel, the green subpixel and the blue subpixel as time passes. Thus, the gate off voltage may not have a fixed value but a varied value as time passes.

For example, the first gate off voltage VSS1 of the gate signal applied to the red subpixel may decrease from an initial gate off voltage VSS0 as time passes.

For example, the second gate off voltage VSS2 of the gate signal applied to the green subpixel may decrease from the initial gate off voltage VSS0 as time passes.

For example, the third gate off voltage VSS3 of the gate signal applied to the blue subpixel may decrease from the initial gate off voltage VSS0 as time passes.

The decrements of the first to third gate off voltages VSS1 to VSS3 may be different from one another. For example, a third decrement dec3 of the third gate off voltage VSS3 applied to the blue subpixel may be greater than a second decrement dec2 of the second gate off voltage VSS2 applied to the green subpixel. For example, the second decrement dec2 of the second gate off voltage VSS2 applied to the green subpixel may be greater than a first decrement dec1 of the first gate off voltage VSS1 applied to the red subpixel.

In the present exemplary embodiment, the first to third gate off voltages VSS1, VSS2 and VSS3 may respectively decrease from the initial gate off voltage VSS0 and then increase as time passes. According to the characteristics of the switch TR, the threshold voltage may shift in a left direction in an X axis in FIG. 2 before a moment (e.g. t1) as time passes and may shift in a right direction in the X axis after the moment (e.g. t1) as time passes. Thus, if the level of the gate off voltage decreases and increases as time passes, the shift of the threshold voltage of the switch TR may be compensated.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 17:
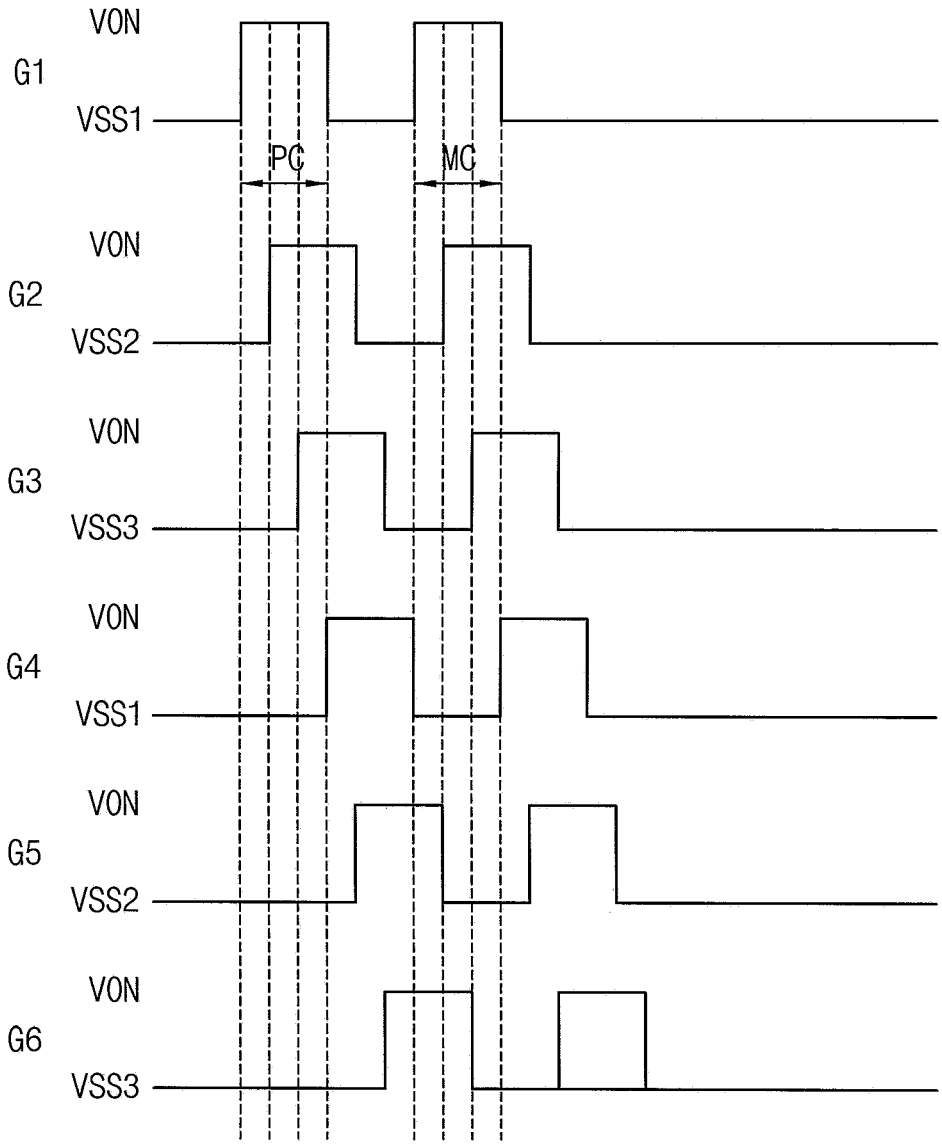
FIG. 17 is a timing diagram illustrating a gate signal according to an exemplary embodiment.

FIG. 17 is a timing diagram illustrating a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the method of compensating the charging rate is further applied. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 17, the gate signal G1 to G6 may have a main charge gate pulse corresponding to a main charge duration MC and a precharge gate pulse corresponding to a precharge duration PC prior to the main charge duration MC.

The display defect due to the deterioration of the switch TR may be seriously intensified when the charging rate of the subpixel voltage is insufficient. Thus, when the method of precharge of FIG. 17 to increase the charging rate of the subpixel voltage is applied to the exemplary embodiments explained referring to FIGS. 1 to 16, the display defect may further be reduced.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 18:
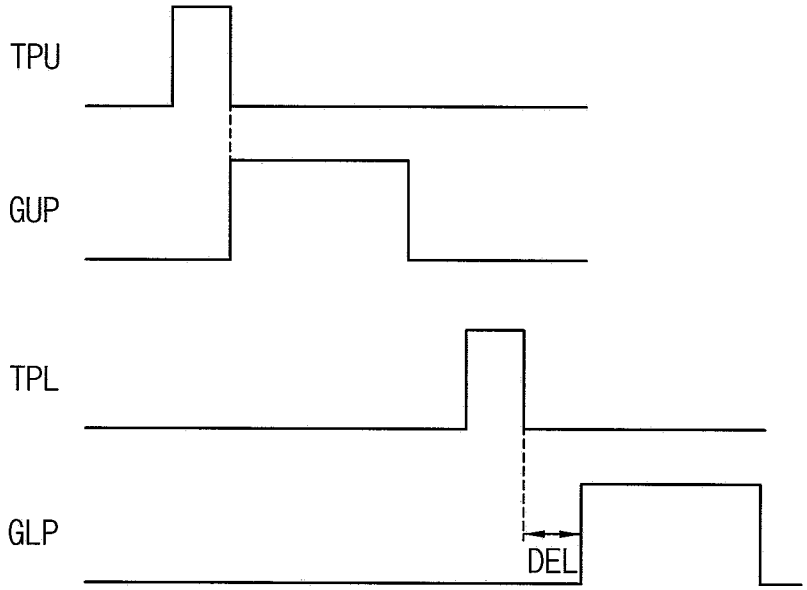
FIG. 18 is a timing diagram illustrating a load signal and a gate signal according to an exemplary embodiment.

FIG. 18 is a timing diagram illustrating a load signal and a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the method of compensating the charging rate is further applied. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 18, a gate signal GLP applied to a lower portion of the display panel 100 may be delayed than a gate signal GUP applied to an upper portion of the display panel 100. The gate signal GLP applied to the lower portion of the display panel 100 may be delayed by a delaying duration DEL with respect to a load signal TPL of the lower portion of the display panel 100. In contrast, the gate signal GUP applied to the upper portion of the display panel 100 may not be delayed with respect to a load signal TPU of the upper portion of the display panel 100.

The display defect due to the deterioration of the switch TR may be seriously intensified when the charging rate of the subpixel voltage is insufficient. Thus, when the method of gate shift of FIG. 18 to increase the charging rate of the subpixel voltage is applied to the exemplary embodiments explained referring to FIGS. 1 to 16, the display defect may be reduced.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 19:
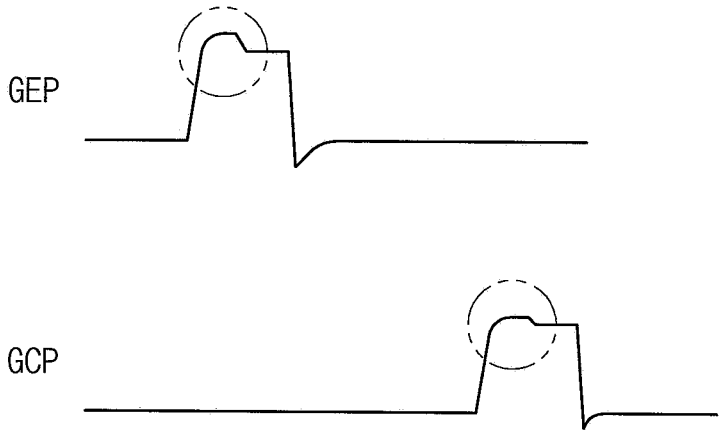
FIG. 19 is a timing diagram illustrating a gate signal according to an exemplary embodiment.

FIG. 19 is a timing diagram illustrating a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the method of compensating the charging rate is further applied. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 19, a gate pulse of the gate signal GEP and GCP may have a normal driving duration and an overdriving duration having a voltage level greater than a voltage level of the normal driving duration. When the gate signal GEP and GCP are overdriven, the gate signal may maintain a desirable pulse of the gate signal even though the R-C delay is generated in the gate signal. Thus, the charging rate of the subpixel voltage may not be decreased. For example, the gate signal GEP may be applied to an area having the relatively low R-C delay. The area having the relatively low R-C delay may be an edge portion of the display panel 100. For example, the gate signal GCP may be applied to an area having the relatively high R-C delay. The area having the relatively high R-C delay may be a central portion of the display panel 100. The gate signal is overdriven so that the difference of the waveforms of the gate signals in the area having the relatively low R-C delay and in the area having the relatively high R-C delay is not great. Thus, the charging rate of the subpixel voltage may be maintained in a desirable level in spite of the varied R-C delay.

The display defect due to the deterioration of the switch TR may be seriously intensified when the charging rate of the subpixel voltage is insufficient. Thus, when the method of gate overdriving of FIG. 19 to increase the charging rate of the subpixel voltage is applied to the exemplary embodiments explained referring to FIGS. 1 to 16, the display defect may be reduced.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

Figure 20:
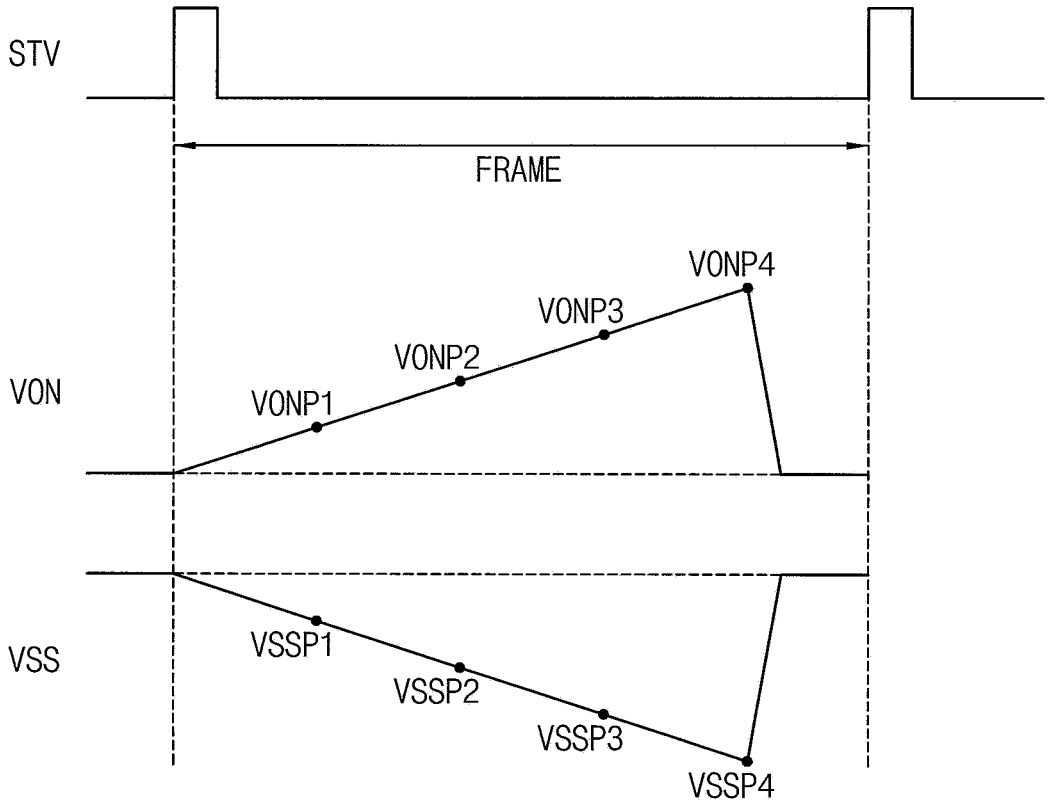
FIG. 20 is a timing diagram illustrating a gate on voltage and a gate off voltage to generate a vertical start signal and a gate signal according to an exemplary embodiment.

FIG. 20 is a timing diagram illustrating a gate on voltage and a gate off voltage to generate a vertical start signal and a gate signal according to an exemplary embodiment.

The display apparatus and the method of driving the display panel according to the present exemplary embodiment is substantially the same as the display apparatus and the method of driving the display panel of the previous exemplary embodiment explained referring to FIGS. 1 to 5 except that the method of compensating the charging rate is further applied. Thus, the same reference numerals will be used to refer to the same or like parts as those described in the previous exemplary embodiment of FIGS. 1 to 5 and any repetitive explanation concerning the above elements will be omitted.

Referring to FIGS. 1 to 5 and 20, the level VONP1, VONP2, VONP3, VONP4 of the gate on voltage VON defining the high level of the gate signal may increase as time passes in a frame. In addition, the level VSSP1, VSSP2, VSSP3, VSSP4 of the gate off voltage VON defining the low level of the gate signal may decrease as time passes in the frame. Accordingly, the difference of the level of the gate on voltage VON and the level of the gate off voltage VSS due to the IR drop according to the position of the gate line may be compensated. The frame may be defined by duration between adjacent vertical start signals STV.

The display defect due to the deterioration of the switch TR may be seriously intensified when the charging rate of the subpixel voltage is insufficient. Thus, when the method of gate overdriving of FIG. 20 to increase the charging rate of the subpixel voltage is applied to the exemplary embodiments explained referring to FIGS. 1 to 16, the display defect may be reduced.

According to the present exemplary embodiment, the gate off voltage of the gate signal applied to the subpixel may be varied according to the color of the subpixel. Thus, the difference of the deterioration of the switch TR according to the color of the subpixel may be compensated. Therefore, the display defect of the display panel 100 due to the deterioration of the switch TR may be compensated so that the display quality of the display panel 100 may be enhanced.

According to the exemplary embodiments of the display apparatus and the method of driving the display panel, the display defect of the display panel due to the deterioration of the switch TR may be prevented so that the display quality of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a display panel configured to display an image;

a gate driver configured to output a gate signal to the display panel; and a data driver configured to output a data voltage to the display panel, wherein the display panel includes a first subpixel row including first subpixels having a first color and a second subpixel row including second subpixels having a second color, wherein a first gate off voltage of a first gate signal selectively applied to the first subpixels having the first color is different from a second gate off voltage of a second gate signal selectively applied to the second subpixels having the second color, and wherein a gate off voltage of a gate signal applied to a blue subpixel is less than a gate off voltage of a gate signal applied to a subpixel which is not the blue subpixel.

2. The display apparatus of claim 1, wherein a gate off voltage of a gate signal applied to a green subpixel is less than a gate off voltage of a gate signal applied to a red subpixel.

3. The display apparatus of claim 1, wherein a first gate on voltage of the first gate signal applied to the first subpixel row to turn on the switching elements of the first subpixel row is different from a second gate on voltage of the second gate signal applied to the second subpixel row to turn on the switching elements of the second subpixel row.

4. The display apparatus of claim 3, wherein a gate on voltage of a gate signal applied to a green subpixel is less than a gate on voltage of a gate signal applied to a red subpixel.

5. The display apparatus of claim 1, wherein subpixel rows of the display panel alternately display red, green and blue colors, and wherein the gate driver is configured to generate gate signals alternately based on six gate clock signals having six different phases.

6. The display apparatus of claim 5, wherein first and seventh gate signals respectively applied to first and seventh subpixel rows are generated based on a first gate clock signal having a gate on voltage and a first gate off voltage, wherein second and eighth gate signals respectively applied to second and eighth subpixel rows are generated based on a second gate clock signal having the gate on voltage and a second gate off voltage different from the first gate off voltage, wherein third and ninth gate signals respectively applied to third and ninth subpixel rows are generated based on a third gate clock signal having the gate on voltage and a third gate off voltage different from the first and second gate off voltages, wherein fourth and tenth gate signals respectively applied to fourth and tenth subpixel rows are generated based on a fourth gate clock signal having the gate on voltage and the first gate off voltage, wherein fifth and eleventh gate signals respectively applied to fifth and eleventh subpixel rows are generated based on a fifth gate clock signal having the gate on voltage and the second gate off voltage, and wherein sixth and twelfth gate signals respectively applied to sixth and twelfth subpixel rows are generated based on a sixth gate clock signal having the gate on voltage and the third gate off voltage.

7. The display apparatus of claim 5, wherein first and seventh gate signals respectively applied to first and seventh subpixel rows are generated based on a first gate clock signal having a first gate on voltage and a first gate off voltage, wherein second and eighth gate signals respectively applied to second and eighth subpixel rows are generated based on a second gate clock signal having a second gate on voltage different from the first gate on voltage and a second gate off voltage different from the first gate off voltage, wherein third and ninth gate signals respectively applied to third and ninth subpixel rows are generated based on a third gate clock signal having a third gate on voltage different from the first and second gate on voltages and a third gate off voltage different from the first and second gate off voltages, wherein fourth and tenth gate signals respectively applied to fourth and tenth subpixel rows are generated based on a fourth gate clock signal having the first gate on voltage and the first gate off voltage, wherein fifth and eleventh gate signals respectively applied to fifth and eleventh subpixel rows are generated based on a fifth gate clock signal having the second gate on voltage and the second gate off voltage, and wherein sixth and twelfth gate signals respectively applied to sixth and twelfth subpixel rows are generated based on a sixth gate clock signal having the third gate on voltage and the third gate off voltage.

8. The display apparatus of claim 1, wherein subpixel rows of the display panel alternately display red, green and blue colors, and wherein the gate driver is configured to generate gate signals alternately based on twelve gate clock signals having twelve different phases.

9. The display apparatus of claim 8, wherein first, fourth, seventh and tenth gate signals respectively applied to first, fourth, seventh and tenth subpixel rows are respectively generated based on first, fourth, seventh and tenth gate clock signals having a gate on voltage and a first gate off voltage, wherein second, fifth, eighth and eleventh gate signals respectively applied to second, fifth, eighth and eleventh subpixel rows are respectively generated based on second, fifth, eighth and eleventh gate clock signals having the gate on voltage and a second gate off voltage different from the first gate off voltage, and wherein third, sixth, ninth and twelfth gate signals respectively applied to third, sixth, ninth and twelfth subpixel rows are respectively generated based on third, sixth, ninth and twelfth gate clock signals having the gate on voltage and a third gate off voltage different from the first and second gate off voltages.

10. The display apparatus of claim 8, wherein first, fourth, seventh and tenth gate signals respectively applied to first, fourth, seventh and tenth subpixel rows are respectively generated based on first, fourth, seventh and tenth gate clock signals having a first gate on voltage and a first gate off voltage, wherein second, fifth, eighth and eleventh gate signals respectively applied to second, fifth, eighth and eleventh subpixel rows are respectively generated based on second, fifth, eighth and eleventh gate clock signals having a second gate on voltage different from the first gate on voltage and a second gate off voltage different from the first gate off voltage, and wherein third, sixth, ninth and twelfth gate signals respectively applied to third, sixth, ninth and twelfth subpixel rows are respectively generated based on third, sixth, ninth and twelfth gate clock signals having a third gate on voltage different from the first and second gate on voltages and a third gate off voltage different from the first and second gate off voltages.

11. The display apparatus of claim 1, wherein subpixel rows of the display panel alternately display red, green and blue colors, and wherein the gate driver is configured to generate gate signals alternately based on four gate clock signals having four different phases.

12. The display apparatus of claim 11, wherein first, fifth and ninth gate signals respectively applied to first, fifth and ninth subpixel rows are generated based on a first gate clock signal, wherein second, sixth and tenth gate signals respectively applied to second, sixth and tenth subpixel rows are generated based on a second gate clock signal different from the first gate clock signal, wherein third, seventh and eleventh gate signals respectively applied to third, seventh and eleventh subpixel rows are generated based on a third gate clock signal different from the first and second gate clock signals, and wherein fourth, eighth and twelfth gate signals respectively applied to fourth, eighth and twelfth subpixel rows are generated based on a fourth gate clock signal different from the first, second and third gate clock signals.

13. The display apparatus of claim 12, wherein each of the first to fourth gate clock signals sequentially has a first gate off voltage a second gate off voltage and a third gate off voltage which are different from one another.

14. The display apparatus of claim 12, wherein each of the first to fourth gate clock signals sequentially has a first gate on voltage, a first gate off voltage, a second gate on voltage, a second gate off voltage, a third gate on voltage and a third gate off voltage, and wherein the first gate on voltage, the second gate on voltage and the third gate on voltage are different from one another, and a first gate off voltage, a second gate off voltage and a third gate off voltage are different from one another.

15. The display apparatus of claim 1, wherein each of the first gate off voltage and the second gate off voltage is varied as time passes, and wherein a decrement of the first gate off voltage is different from a decrement of the second gate off voltage.

16. The display apparatus of claim 15, wherein each of the first gate off voltage and the second gate off voltage decreases as time passes.

17. The display apparatus of claim 15, wherein each of the first gate off voltage and the second gate off voltage decreases until a predetermined time passed and then increases as time passes.

18. The display apparatus of claim 1, wherein the gate signal has a main charge gate pulse and a precharge gate pulse prior to the main charge gate pulse.

19. The display apparatus of claim 1, wherein a gate signal applied to a lower portion of the display panel is delayed than a gate signal applied to an upper portion of the display panel with respect to a load signal.

20. The display apparatus of claim 1, wherein a gate pulse of the gate signal has a normal driving duration and an overdriving duration having a voltage level greater than a voltage level of the normal driving duration.

21. The display apparatus of claim 1, wherein a gate on voltage defining a high level of the gate signal increases as time passes in a frame, and wherein a gate off voltage defining a low level of the gate signal decreases as time passes in the frame.

22. A method of driving a display panel, the method comprising:

outputting a gate signal to the display panel; and outputting a data voltage to the display panel, wherein the display panel includes a first subpixel row including first subpixels having a first color and a second subpixel row including second subpixels having a second color, wherein a first gate off voltage of a first gate signal selectively applied to the first pixels having the first color is different from a second gate off voltage of a second gate signal selectively applied to the second subpixels having the second color, wherein the first color is a blue color and the second color is a color other than the blue color, and wherein the first gate off voltage is lower than the second gate off voltage.

23. The method of claim 22, wherein a first gate on voltage is applied to the first subpixels and the second subpixels.

24. The method of claim 22, wherein a first gate on voltage is applied to the first subpixels and a second gate on voltage which is different from the first gate on voltage is applied to the second subpixels.

25. The method of claim 24, wherein the first gate on voltage is lower than the second gate on voltage.

26. The method of claim 22, wherein the display panel further includes a third subpixel row including third subpixels having a third color, a third gate off voltage of a third gate signal being applied to the third subpixel row to turn off switching elements of the third subpixel row, wherein the first color, the second color and the third color are the blue color, a green color and a red color, respectively, and wherein the first gate off voltage is lower than the second gate off voltage and the third gate off voltage, and the third gate off voltage is higher than the second gate off voltage.

27. The method of claim 26, wherein a first gate on voltage is applied to the first subpixels, the second subpixels and the third subpixels.

28. The method of claim 26, wherein a first gate on voltage is applied to the first subpixels, a second gate on voltage which is higher than the first gate on voltage is applied to the second subpixels, and a third gate on voltage which is higher than the second gate on voltage is applied to the third subpixels.

* * * * *